US010435200B2

(12) United States Patent
Feris et al.

(10) Patent No.: US 10,435,200 B2
(45) Date of Patent: Oct. 8, 2019

(54) SAFETY STORAGE SYSTEM AND METHOD

(71) Applicant: HANGMAN SYSTEMS, LLC, Livingston, TX (US)

(72) Inventors: Dee A Feris, Livingston, TX (US); Ray L Mays, Livingston, TX (US); Albert B Deaver, Jr., Hunters Creek, TX (US)

(73) Assignee: Hangman Systems, LLC, Livingston, TX (US)

( * ) Notice: Subject to any disclaimer, the term of this patent is extended or adjusted under 35 U.S.C. 154(b) by 0 days.

(21) Appl. No.: 15/702,707

(22) Filed: Sep. 12, 2017

(65) Prior Publication Data

US 2018/0009571 A1 Jan. 11, 2018

Related U.S. Application Data

(63) Continuation-in-part of application No. 13/897,106, filed on May 17, 2013, now Pat. No. 9,759,516.
(Continued)

(51) Int. Cl.

| | |
|---|---|
| ***B65D 85/00*** | (2006.01) |
| ***B65D 25/22*** | (2006.01) |
| ***B65D 25/32*** | (2006.01) |
| ***E05B 69/00*** | (2006.01) |
| ***E05G 1/00*** | (2006.01) |
| ***F41C 33/06*** | (2006.01) |

(Continued)

(52) U.S. Cl.
CPC ..... *B65D 25/22* (2013.01); *A47G 25/14* (2013.01); *B65D 25/32* (2013.01); *E05B 69/006* (2013.01); *E05G 1/005* (2013.01); *E05G 1/10* (2013.01); *F41C 33/06* (2013.01); *E05G 2700/04* (2013.01); *E05Y 2201/10* (2013.01); *F41C 33/0263* (2013.01); *F41C 33/048* (2013.01)

(58) Field of Classification Search
CPC ..... B65D 25/22; B65D 25/32; B65D 85/18; B65D 85/185; F16B 45/00; F16B 41/005; A45C 13/03; A47F 7/02; F41C 33/06; F41C 33/0263; F41C 33/048; A47G 25/14; E05B 69/006; E05G 1/005; E05G 1/10; E05G 2700/14
USPC ..... 206/317, 278, 278.1, 9, 280, 6.1, 806, 206/1.5; 24/716; 312/245, 204; 70/2–13; 411/910
See application file for complete search history.

(56) References Cited

U.S. PATENT DOCUMENTS 2,024,442 A 12/1935 Flocco
3,743,083 A * 7/1973 James ..... A47G 25/1457 206/287

(Continued)

OTHER PUBLICATIONS

Thomas, S., International Search Report for International Patent Application No. PCT/US2014/027000, ISA/US, dated Jul. 17, 2014.

(Continued)

*Primary Examiner* — Rafael A Ortiz
(74) *Attorney, Agent, or Firm* — McAughan Deaver PLLC

(57) ABSTRACT

A storage system, comprising a body having a cavity therein configured to house one or more items, and an opening defined by the body and a panel configured to mate with the opening and prevent access to the cavity when the panel is in position; the system have a first level of security securing items stored in the cavity; a second level of security securing the body from a structure from which it is hung, and an third level of security disguising the storage system as a hanging piece of clothing.

20 Claims, 18 Drawing Sheets

Related U.S. Application Data

(60) Provisional application No. 61/803,438, filed on Mar. 19, 2013.

(51) Int. Cl.

| | |
|---|---|
| ***A47G 25/14*** | (2006.01) |
| ***E05G 1/10*** | (2006.01) |
| *F41C 33/02* | (2006.01) |
| *F41C 33/04* | (2006.01) |

(56) References Cited

U.S. PATENT DOCUMENTS

| | | | | |
|---|---|---|---|---|
| 3,930,702 | A | 1/1976 | Pichowicz | |
| 4,024,997 | A | 5/1977 | Kolpin | |
| 4,782,947 | A | 11/1988 | Sheiman, Sr. | |
| 4,854,656 | A * | 8/1989 | O'Keefe | A45C 11/16 312/334.23 |
| 4,880,089 | A | 11/1989 | Chombert et al. | |
| 5,957,308 | A | 9/1999 | Zierenberg | |
| 6,161,686 | A * | 12/2000 | Simon | A45C 11/16 206/6.1 |
| 6,607,085 | B2 | 8/2003 | Pavlic | |
| 6,685,023 | B2 * | 2/2004 | Bleggi | A45C 11/16 206/493 |
| 7,389,868 | B2 | 6/2008 | Lewand et al. | |
| 7,537,109 | B1 * | 5/2009 | Shevick | B65D 25/106 206/482 |
| 7,731,074 | B2 * | 6/2010 | Martin | B23K 3/022 228/51 |
| 9,593,523 | B1 * | 3/2017 | Trimble | E05G 1/14 |
| 2005/0011786 | A1 | 1/2005 | Wood et al. | |
| 2006/0164208 | A1 | 7/2006 | Schaffzin et al. | |
| 2008/0035523 | A1 | 2/2008 | Lemire | |
| 2008/0203860 | A1 * | 8/2008 | Myers | A47B 81/005 312/204 |
| 2010/0282804 | A1 | 11/2010 | Stimmell, Sr. | |
| 2017/0030109 | A1 * | 2/2017 | Duncan | G07C 9/00309 |

OTHER PUBLICATIONS

Thomas, S., Written Opinion for International Patent Application No. PCT/US2014/027000, ISA/US, dated Jul. 17, 2014.

Moon, K, International Preliminary Report on Patentability for International Patent Application No. PCT/US2014/027000, The International Bureau of WIPO, dated Sep. 22, 2015.

www.itstactical.com, 40 Unique Places to Stash Firearms, Jun. 23, 2010, 1 Page.

forum.cralri.com, WTS—"Hang N Hide" Locked Pistol Case, Jun. 7, 2009, 1 Page.

www.ar15.com, WTS: Handgun Hang n Hide, Gorilla Rack, Gun Lock . . . , Dec. 1, 2012, 1 Page.

United States Patent and Trademark Office, Registration No. 2,046,835, Mar. 18, 1997, 1 Page.

* cited by examiner

SAFETY STORAGE SYSTEM AND METHOD

CROSS REFERENCE TO RELATED APPLICATIONS

This application is a continuation-in-part of, and claims priority to and benefit of, U.S. patent application Ser. No. 13/897,106, filed on May 17, 2013, now U.S. Pat. No. 9,759,516, which claims priority to and benefit of U.S. Provisional Patent Application Ser. No. 61/803,438, filed on Mar. 19, 2013, the disclosure of each of which is incorporated herein by reference for all purposes.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The inventions disclosed and taught herein relate generally to devices and methods for storing or containing items, such as weapons and other valuable against unwanted access; and more specifically relate to a portable or mobile locker system and method of use.

Description of the Related Art

Art that may or may not be related to my inventions taught herein include the following.

U.S. Pat. No. 4,024,997 to Kolpin is entitled "Gun case including means for suspending the gun case from a support" and discloses "[a] gun case including means for suspending the gun case from a support in such a manner that the gun case may be conveniently stored. The gun case includes at least one openable loop securely attached thereto and receivable around a support such as a clothes rod or a hanger to permit the gun case to be suspended from the support. The openable loops supporting the gun case are releasably secured by metal snaps, buckles or Velcro straps. The gun case may be provided with a rigid hanger receiving a pair of spaced openable loops and permitting the gun case to be suspended from the rod of a clothes closet. The gun case may also be provided with means for permitting the gun case to be attached to a belt and thereby form a holster and including a resilient bumper secured to the end of the gun case to protect the muzzle of a gun received in the gun case and zipper-like slidable fastener means which permit access to the gun within the gun case such that the gun therein may be easily removed when the gun case is used as a holster."

U.S. Pat. No. 6,161,686 to Simon is entitled "Garment-concealable jewelry case having parallel-running compartments and integrated jewelry trays for storing and organizing jewelry" and discloses "A garment-concealable jewelry case having a front opening with a front cover panel portion that can be either moved or configured to reveal a plurality of parallel-running isolated storage compartments each having an interior storage space which is accessible through a front opening revealed when the front cover panel is removed or reconfigured. Through the front opening of each storage compartment, one or more necklaces, pendants, bracelets or other strands of jewelry can be securely hung on a pair of jewelry support posts adapted for spatial separation on the back wall portion of the storage compartment in order to accommodate the length of jewelry strands being supported. The bottom portion of each parallel-running isolated compartment has a stationary front panel portion which, cooperating with the other wall portions of the storage compartment, provides a five sided stationary storage tray accessible through the opening of the respective storage compartment and within which articles of jewelry such as rings, watches, earrings and/or tie tacks can be placed for organization and storage. The front cover panel has a tray cover panel integrated therewith, which closes off each jewelry storage compartment when the front cover panel is positioned over the access opening formed in the case housing. When the front cover panel is closed, the jewelry support posts contact the rear surface of the front cover panel to prevent supported articles of jewelry from falling off and tossing about within the storage compartment during usage, including travel."

U.S. Pat. No. 6,607,085 to Pavlic is entitled "Closet hiding place" discloses that "[t]he closet hiding place includes a plurality of telescopic channels that can be adjusted relative to each other to extend the length of a wall above a closet door. The channels are either generally rectangular or semicircular with an open top and simulate a duct when installed in a closet. The channels are mounted to the wall by the extension of fasteners through slots along the upper edge of the back wall of each channel. The front and bottom walls are longer than the back wall to enable the channel to sit flush against the wall. The open top enables a user to place items in the channels to obscure the items from the view of unauthorized persons such as thieves or small children."

BRIEF SUMMARY OF THE INVENTION

Summarized briefly, the inventions taught herein concern a disguisable and mobile storage system, comprising a body having a cavity therein configured to house one or more items, and an opening defined by the body and providing access to the cavity; a closure member configured to mate with the opening and prevent access to the cavity when the member is in position in the opening; a first security mechanism between the body and the closure member providing a secured condition in which the member is locked to the body thereby preventing removal of the member and access to the cavity, and an unlocked condition in which the member is not locked to the body thereby allowing access to the cavity; a hanger and hook system coupled to the body and configured to suspend the body from a structure; a second security mechanism coupled to the hook and the body and configured to secure the suspend the storage system from the structure from which it is suspended; and the body configured to be covered by an article of clothing such that if suspended from a clothes rod among other clothes, the storage system is substantially disguised as an article of clothing.

DETAILED DESCRIPTION OF THE INVENTION

Figure 2:
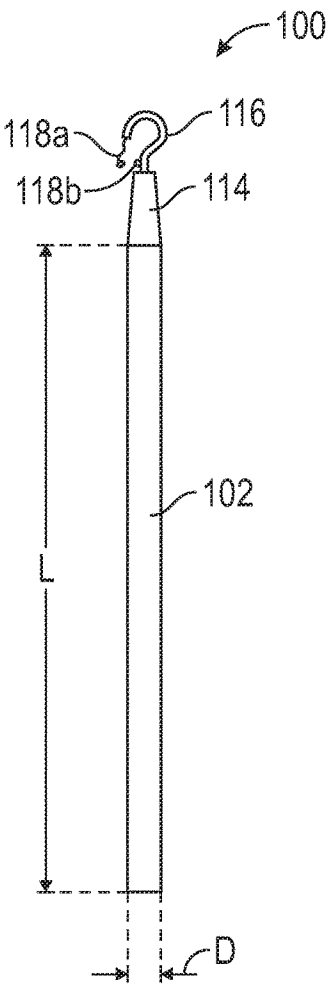
FIG. 2 illustrates a side view of the embodiment in FIG. 1.

The Figures described above and the written description of specific structures and functions below are not presented to limit the scope of what I have invented or the scope of the appended claims. Rather, the Figures and written description are provided to teach a person skilled in the art to make and use the inventions for which I seek patent protection. Those skilled in the art will appreciate that not all features of a commercial embodiment one or or of the inventions are described or shown for the sake of clarity and understanding. Persons of skill in this art will also appreciate that the development of an actual commercial embodiment incorporating one or more aspects of the present inventions will require numerous implementation-specific decisions to achieve the developer's ultimate goal for the commercial embodiment. Such implementation-specific decisions may include, and likely are not limited to, compliance with system-related, business-related, government-related and/or other constraints, which may vary by specific implementation, location and from time to time. While a developer's efforts might be complex and time-consuming in an absolute sense, such efforts would be, nevertheless, a routine undertaking for those of skill in this art having benefit of this disclosure.

It must be understood that the inventions taught herein are susceptible to numerous and various modifications and alternative forms. Indeed, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

As more and more individuals purchase and possess projectile weapons, such and long guns (e.g., rifles, shotguns) and hand guns, and other weapons and valuables; and as more of these weapons and valuables are stored in homes, automobiles and other areas frequented by children, minors, and other untrained in their use, there is a need for an affordable, storage system offering at least a threshold of security against unauthorized access. In addition, as weapons and other valuables become increasingly restricted or controlled, theft of same, including home break-ins, are expected to increase. There is a need, therefore, for a storage system that not only has a threshold of security, but also is not so readily identifiable as a weapon or valuables storage system.

Thus, in general, we have invented a secure storage system that is affordable, portable and disguisable. The system may comprise a body having one or more cavities therein configured to house or store items that may include long guns, such as rifles and shotguns, handguns, ammunition, jewelry, important papers and other items having value to the owner, or items that pose a risk of harm to others.

Embodiments of my invention may comprise a three-dimensional body, generally, but not necessarily, substantially rectangular in shape and having a thickness of preferably between 2 and about 5 inches. Of course, the overall 3D shape of the device can be and should be optimized to facilitate the storage of desired items and the disguisability of the device. For example, an embodiment can be configured such that an article of clothing, such as a shirt, coat, or robe may be hung or draped on the embodiment, much like a clothes hanger. In this way, the device will blend into the other clothes hung in a closet and be relatively hard to discern as a storage system for weapons or valuables.

One portion or end of the device may comprise an attachment component or hook configured to permit the device to be hung from a conventional clothes rod, clothes hook, or other structure that hangs and stores clothing or otherwise can support the embodiment. The attachment component preferably comprises a lock system configured to prevent the embodiment from being removed from what it is hung. Of course, any lock system is only as strong as its weakest link. So, while the embodiment may be locked to, for example, a clothes rod, clothes rod typically may be easily removed from the closet, thereby allowing the storage system to be removed. Nonetheless, the invention described herein provides a certain measure of safety from casual access to items stored in the system, or theft of the storage system Embodiments may be constructed from a variety of materials, including fiberglass, composite materials, polycarbonate (e.g., Lexan) or acrylic (e.g., plexiglass), metal, expanded metal or other such materials that will impart the necessary structural support and security. It will be appreciated that embodiments of the invention likely will not be, and are not required to be, but may be, impenetrable. Rather, embodiments can be constructed to provide impediment or resistance to access, such as by children, teens, and others who should be denied access, yet are not intent on destroying the storage system to gain access to the items stored in the device. A portion of the security provided by the storage system resides in disguising the storage system to not resemble a system for storing valuables or weapons.

Embodiments of the invention can be configured and used to securely store a wide variety of items, such as long guns, hand guns, other weapons, jewelry, important papers, money and the like. For example, and without limiting the appended claims, my invention may comprise a body having a cavity therein configured to house one or more items, and having an opening defined by the body and providing access to the cavity; a panel configured to mate with the opening and prevent access to the cavity when the panel is to the opening; a first lock system operable between the body and the panel and establishing a locked condition in which the panel is secured to the body thereby preventing access to the cavity, and an unlocked condition in which the panel is not secured to the body thereby allowing access to the cavity; an attachment mechanism coupled to one end of the body and configured to suspend the body; a second lock system coupled to the attachment mechanism and configured to lock the device to a suspension device to prevent the body from being removed therefrom; and a disguising structure adapted to cover substantially all of the body and panel so that the portions of the body and panel that are covered and those portions that are uncovered visually blend into the surrounding environment.

Figure 1:
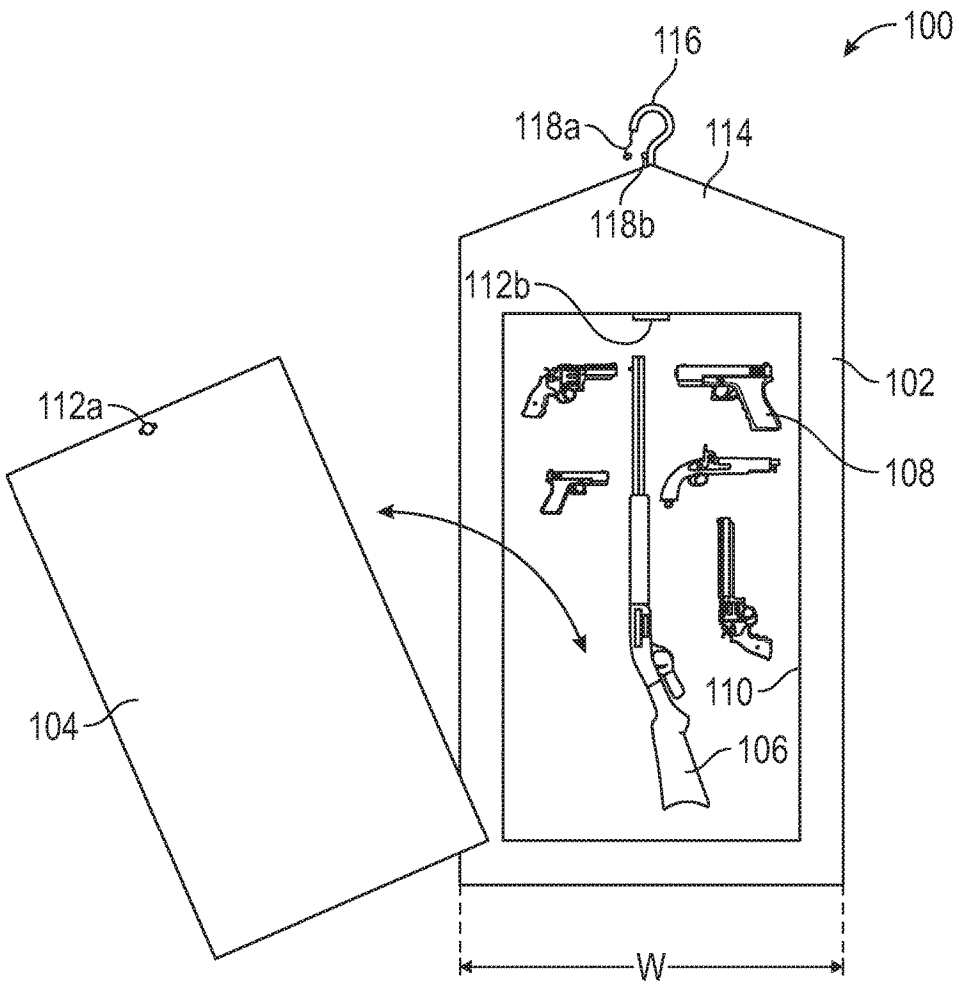
FIG. 1 illustrates one of many possible embodiments of a storage system incorporating aspects of the inventions taught herein.

Turning now to a description of one of many possible embodiments of my invention, FIG. 1 illustrates a storage system 100, comprising a body 102 and an access panel 104. The body 102 may be three-dimensional in that the body encompasses an interior volume in which items may be placed for storage. This volume may also be considered a cavity or storage area. As illustrated in FIG. 1, long guns 106 and hand guns 108 may be placed, stored or secured within the interior volume. As illustrated by FIGS. 1 and 2, the body 102 may have an identifiably width "W", length "L", and depth "D", that defines a length, width and depth (l, w and d) of the interior volume. Those of skill having the benefit of this disclosure will be able to design and construct a storage system of suitable size to store long guns, handguns, jewelry, papers, and other valuables.

Returning to FIG. 1, the body 102 defines an opening 110 that permits access to the interior volume. The size and shape of the opening will be optimized consistent with the size of the interior volume and the type of items to be stored within. The panel or door 104 may be configured to mate with or engage body opening 110 to thereby close off or seal the opening 110. Panel 104 and body 102 may comprise a lock system 112 having one or more components. As illustrated in FIG. 1, lock system 112 may comprise a portion 112*a* located on the panel 104 and a portion 112*b* located on the body 102. Together, these portions form lock system 112. Lock system 112 has an unlocked condition in which the panel 104 is not secured or locked to the body 104 and a locked condition in which the panel 104 is secured or locked to the body. It will be appreciated that when the panel 104 is locked to the panel by way of lock system 112, access to the interior volume (and items stored therein) is encumbered. It will be appreciated that lock system 112 may cooperate with other structures on the body 102 and/or on the panel 104 to secure the panel 104 to the body 102 when in the locked condition. Lock system 112 may comprise any of the well-known lock systems available, such as keyed lock systems, combination lock systems, or biometric lock systems.

Figure 3:
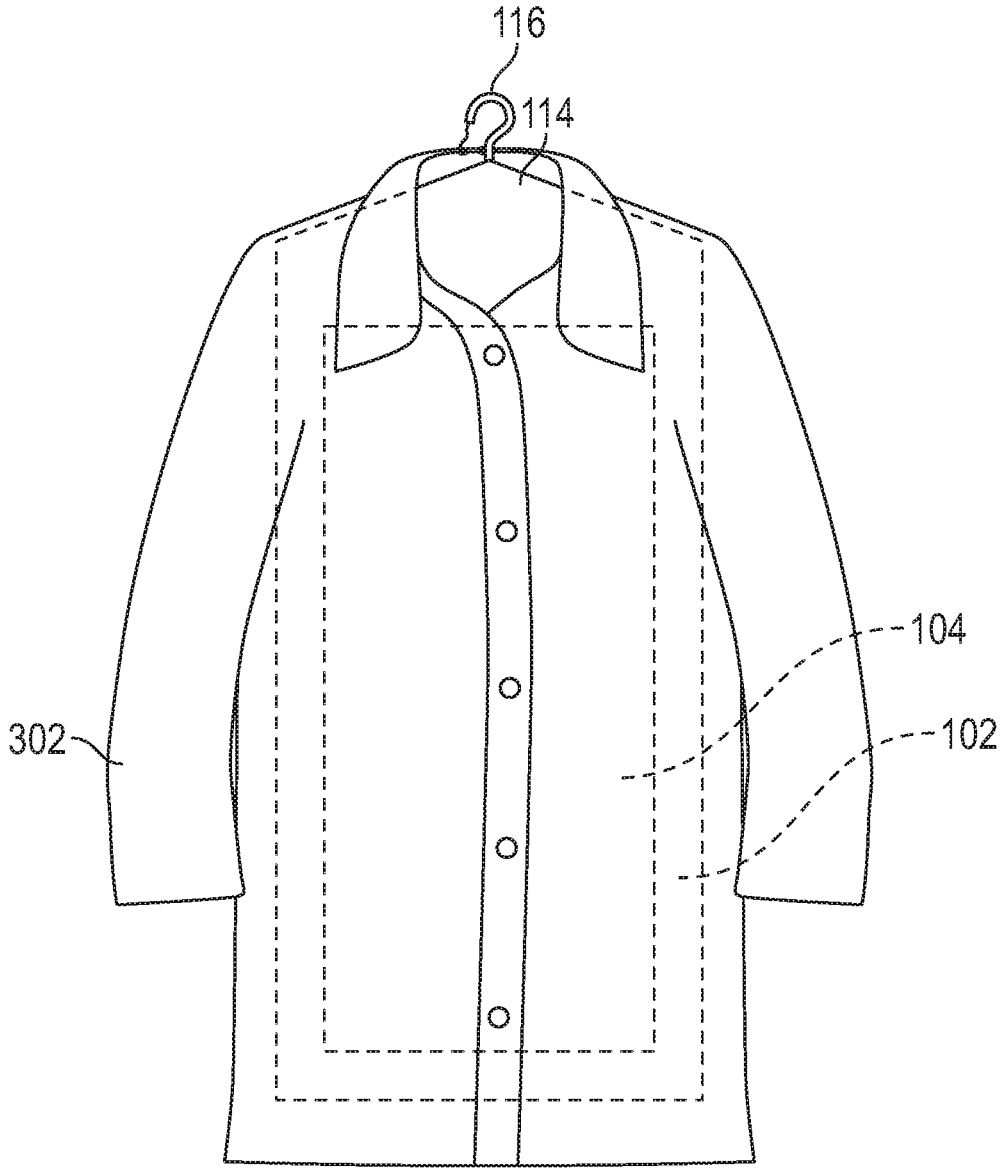
FIG. 3 illustrates disguising an embodiment of a storage system with an article of clothing.

As illustrated in FIGS. 1 and 2, body 102 may comprise a portion 114 that is shaped to more closely resemble hanging clothes when the body is draped with a clothing item 302 as camouflage (See, e.g., FIG. 3). The portion 114 may taper or otherwise change shape in both the width and depth directions as shown, or just the width, or just the depth.

Also illustrated in FIGS. 1 and 2 is attachment component 116. It is presently preferred that attachment component 116 be configured similarly to a clothes hanger hook for hanging attachment to a conventional clothes rod or clothes hook. It is preferred that the attachment component 116 be fabricated from metal or other suitably strong material that prevent breakage caused by the weight of the items in the storage system 100 or breakage caused by someone trying to gain unauthorized access to the storage system 100. Attachment component 116 also preferably, but not necessarily comprises a lock system 118 having cooperating elements 118*a* and 118*b*. Lock system 118 is configured to lock storage system 100 to a bar, rod or hook (not shown) from the storage system 100 is hung.

Figure 4:
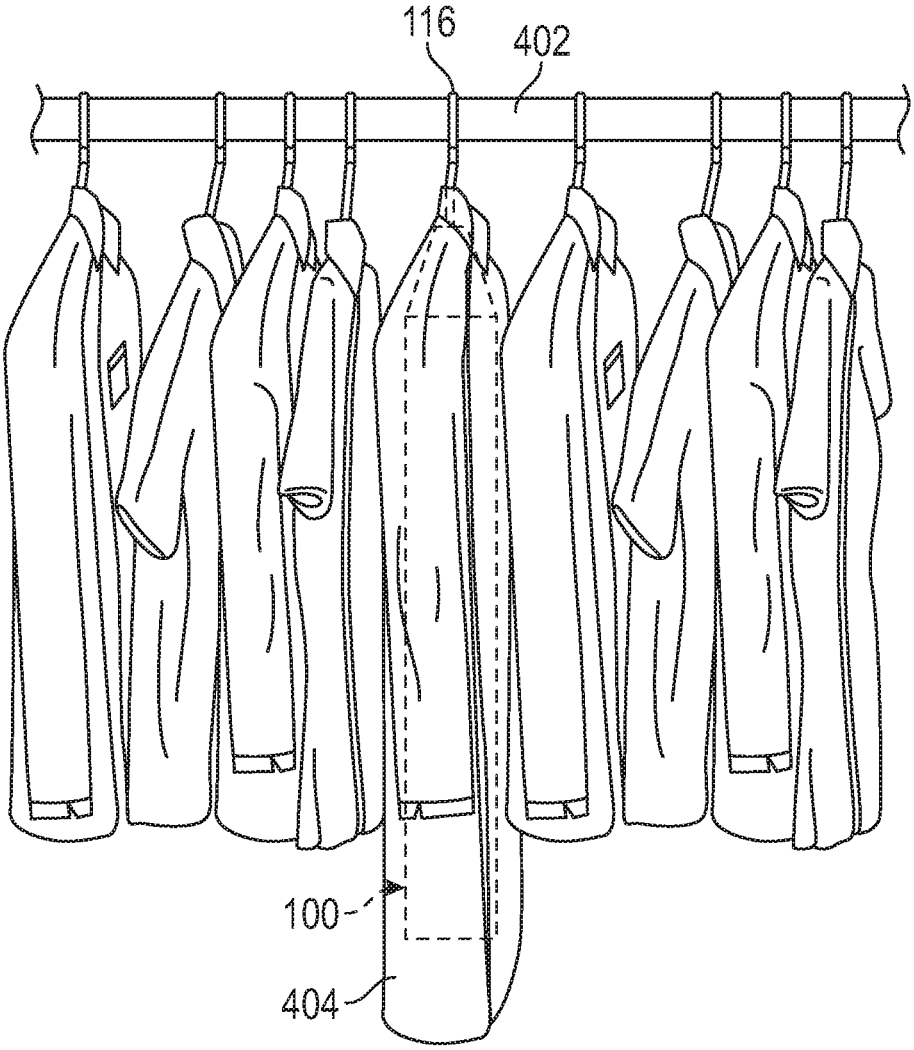
FIG. 4 illustrates an embodiment of a disguised storage system according to the present inventions.

FIG. 4 illustrates a storage system 100 hanging from a clothes rod 402 in a typical closet. The storage system 100 is draped with a man's bathrobe 404 to disguise the storage system 100 among the other clothes. It will now be appreciated that in addition to providing certain level of physical security against unauthorized access, embodiments of my invention also provide security in the form of disguise or camouflage. During thefts or other time-sensitive security breaches, making the location of stored valuables hard to detect may prevent loss of the valuables.

Figure 5:
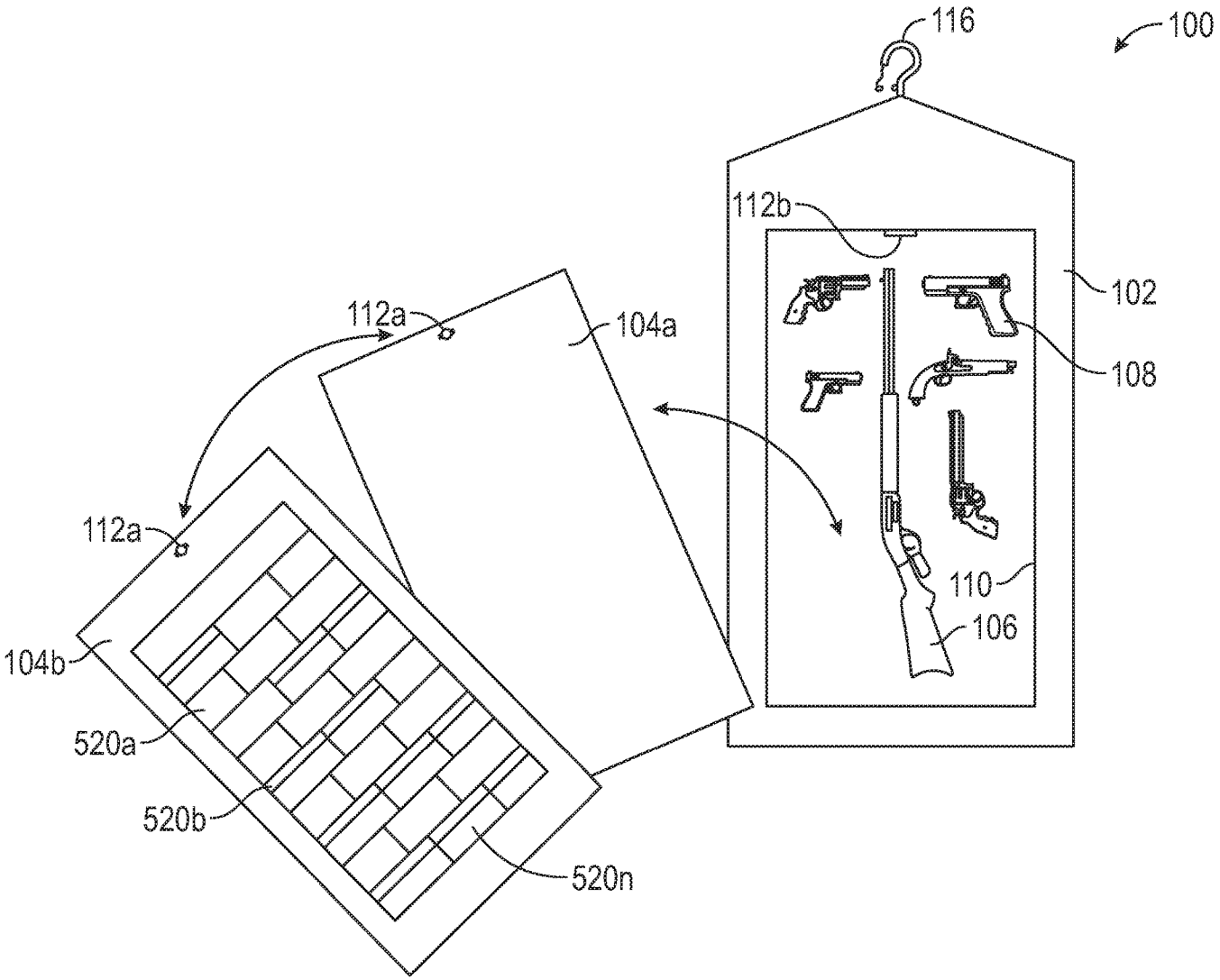
FIG. 5 illustrates another embodiment of storage system.

FIG. 5 illustrates another embodiment of storage system 100 showing along gun 106 and multiple handguns 108 stored within the cavity with the body 102. Also shown is panel 104 having an outside surface 104*a* and an inside surface 104*b*. Inside surface 104*b* is illustrated to have a plurality of compartments 520*a* through 520*n*. It will be appreciated that each compartment or storage area can be of different size, shape, and volume to store a variety of objects and items, such as, but not limited to, jewelry, ammunition, coins, documents and any other valuable or dangerous property. In one embodiment, compartments 520*a* through 520*n* comprise a system of fabric pouches. Other embodiments may comprise individual pouches, compartments or storage devices attachable to the inside surface 104*b* of panel 104.

Figure 6:
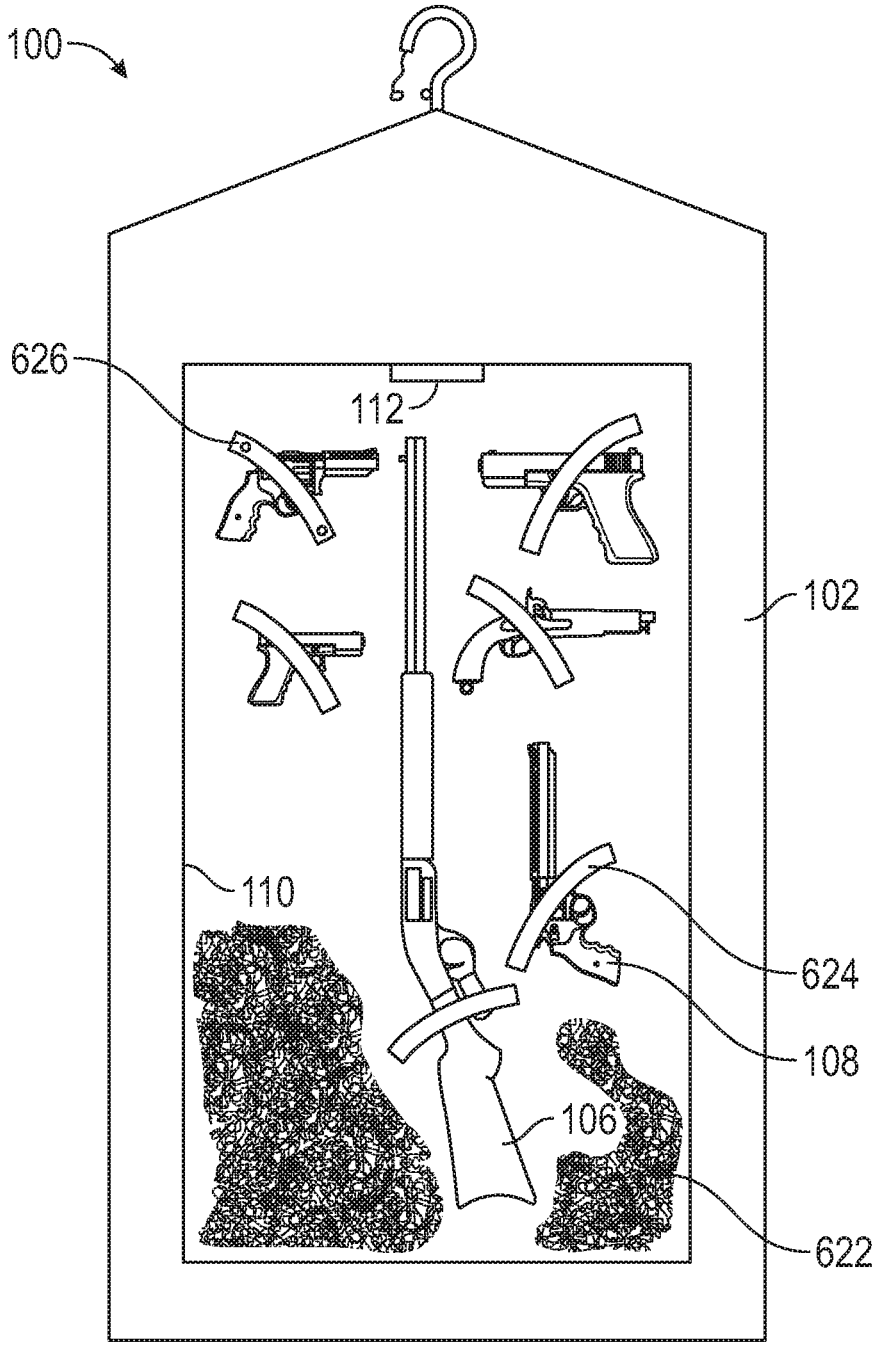
FIG. 6 illustrates a system for securing items within a storage cavity of storage system.

FIG. 6 illustrates one of many possibilities for securing weapons and other items within a storage system 100. The storage area within body 102 may comprise a complementary system of hook and loop materials 622 and 624, such as Velcro®. For example, the storage cavity may be lined with a carpet-like material 622 and hook-type straps 624 may be used to secure items in the storage system 100. An advantage of this type of system is that items can be relocated as desired and items are not restricted to certain predefined locations in the storage system. Alternately, straps 626 may be secured to the storage system through conventional snap systems. This type of system does not allow the same freedom of reorganization because of the predetermined snap locations.

Figure 7A:
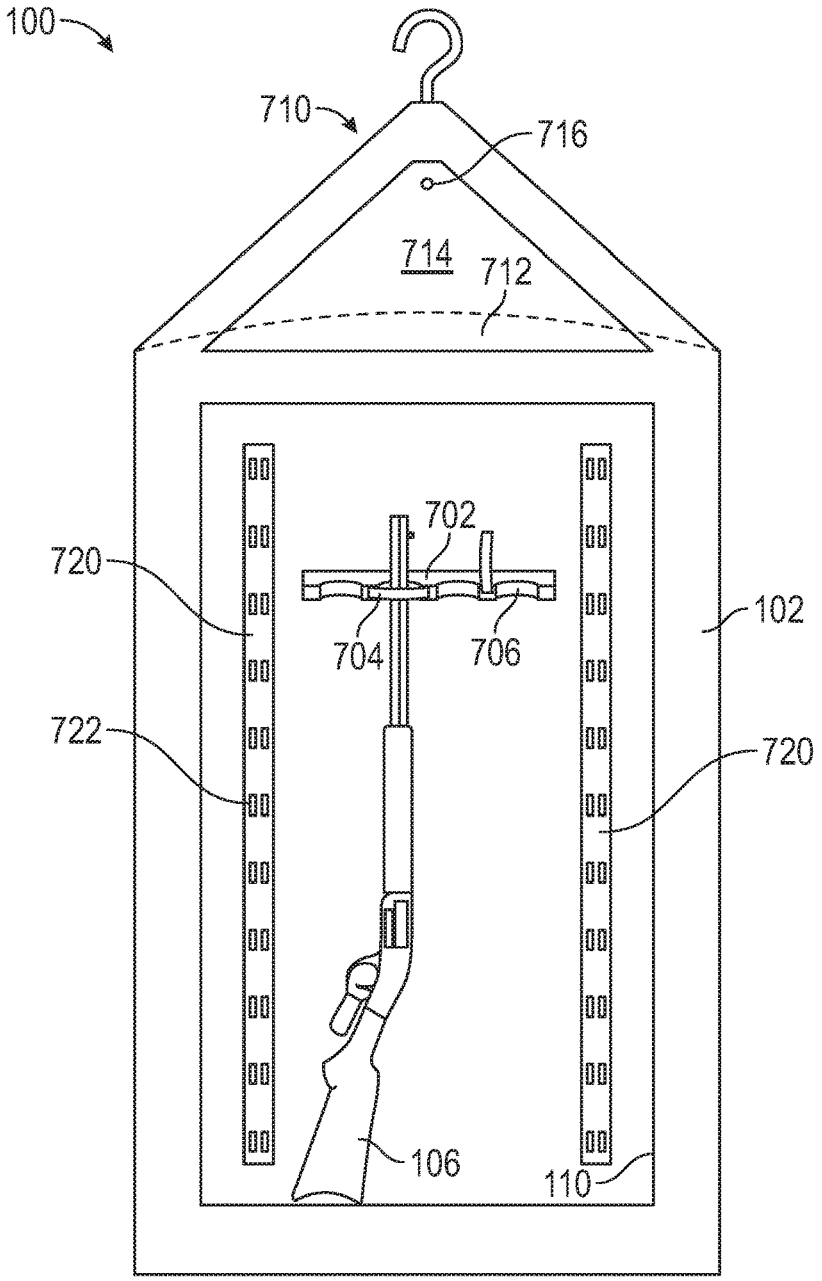
FIGS. 7A-7C illustrate another embodiment of a storage system and another type of system for securing items within a storage cavity of storage system.

FIG. 7A illustrates yet another embodiment of storage system 100 comprising a body 102 having an opening 110 into a storage volume. Panel or door 104 is not shown in this Figure, but those persons of skill will appreciate that a panel or door as previously discussed may be used with this embodiment. Disposed within the storage volume and mounted to the body 102 is a barrel stock 702 that is configured to receive the barrel portion of a long gun 106 as illustrated. Barrel stock 702 preferably has a retention mechanism 704, such as but not limited to a bar or hasp or other physical structure that restrains the barrel with the stock cut out 706. As illustrated in FIG. 7A, the stock of long gun 106 rests on the inner bottom of body 102 and the barrel is secured in barrel stock 702.

Also illustrated in FIG. 7A is additional storage volume 710 that preferably is, but is not require to be, separated from the storage volume accessed by opening 110. This additional storage volume may have a floor 712, which may be considered part of body 102, and may be accessed through a panel or door 714. Door 714 may comprise a lock system 716, similar to the lock systems described for previous embodiments, and such lock system 716 may be keyed similarly or differently to other lock systems on storage system 100. Person of skill will understand the use of "keyed" in this disclosure to refer to actual physical keys, combinations or biometric attributes. Additional storage volume 710 may be used to securely store jewelry, ammunition, papers, and other like valuables.

Figure 7B:
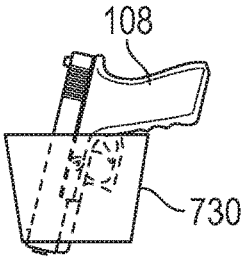
Figure 7C:
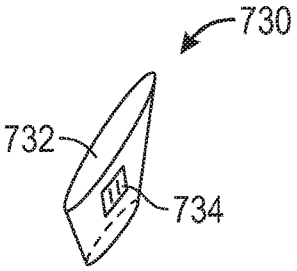

FIG. 7A also illustrates rack system 720 that may be disposed within the main or additional storage volumes and preferably mounted to the body 102. The rack system 702 comprises any of numerous rack systems available, and which typically have openings, projections, or a combination of same 722 for hanging or securing items. For example, as shown in FIGS. 7B and 7C a receptacle 730 may have an opening 732 and be adapted to receive an item such as handgun 108. Receptacle 730 comprises a mounting system 734 for matingly engaging with opening or projections 722 to thereby store handgun 108 within the storage volume. It will be appreciated that a side variety of receptacles 730 can be used with storage system 100, including soft-sided receptacles, such as fabric pouches; leather holsters, and rigid or semi-rigid boxes, that may or may not be separately lockable.

Figure 8A:
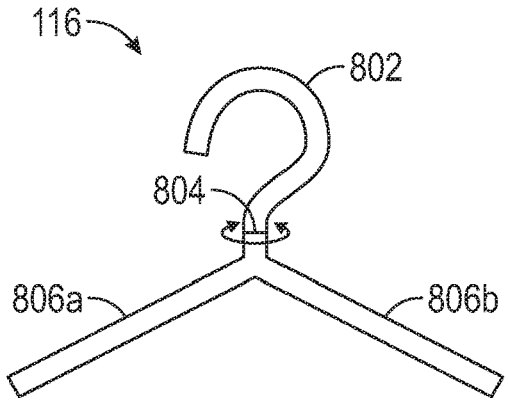
FIGS. 8A-8C illustrate possible embodiments of an attachment mechanism for a storage system.
Figure 8B:
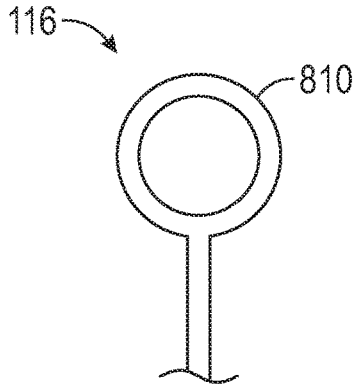
Figure 8C:
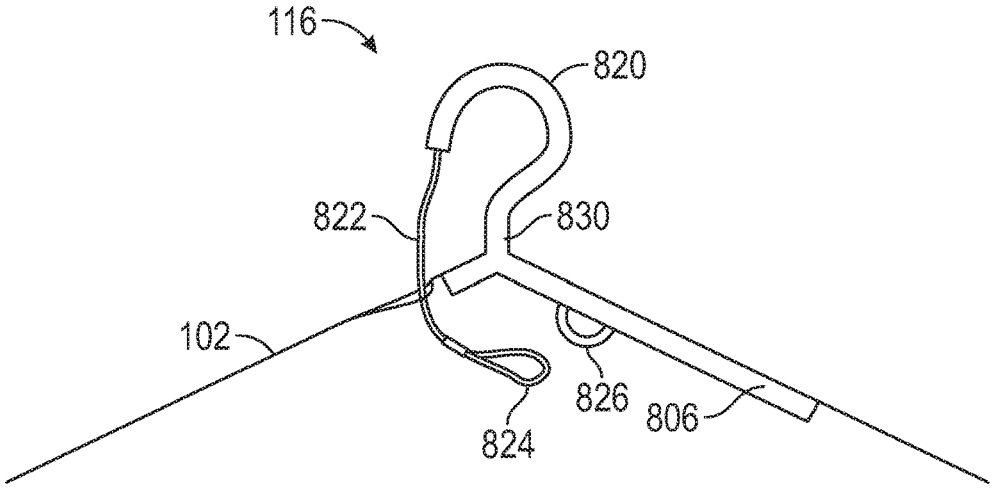

Turning to FIGS. 8A, 8B and 8C, several different embodiments of attachment component 116, such as a hook, are illustrated. FIG. 8A illustrates an open attachment component 802 that does not lock to the item from which it hangs. It will be appreciated that one of the many benefits of the storage system 100 is that the owner/user may select the level of security that is desired or required. By selecting an open attachment component 802, the storage system 100 may be easily and rapidly hung and removed, for example, a conventional clothes rod. In addition, any attachment component may additionally comprise a swivel joint 804 that allows the body 102 to rotate relative to attachment component 116. Rotation in this manner allows easy access to panel 104 (the storage volume) for disposal and retrieval of items. Also shown are mounting flanges 806*a* and 806*b* configured to engage body 102 and spread the weight carried by attachment component 116 across a wider area for body 102.

FIG. 8B illustrates a closed attachment component 116. This type of attachment component 116 may be preferred when the storage system 100 is suspended in a closet from a conventional clothes rod. Such clothes rods are typically removable, and once removed, the clothes rod may be passed through the opening formed by closed attachment component 116. Once the clothes is returned to position, the storage system 100 is secured to the clothes rod and may not be easily removed therefrom without the clothes rod once again being removed. Attachment component 116 may or may not comprise mounting flange(s) as required or desired.

FIG. 8C illustrates a lockable attachment component 820 comprising a flexible member 822, such as wire or chain secured to an end of a curved portion 821 of the attachment component 820 as illustrated. The other end of flexible member 822 has loop or attachment portion 824 formed therein or thereon. Adjacent attachment component 820 in body 102, an opening 103 is formed configured to allow the attachment portion 824 to pass there through into an interior volume of the body 102, but not allow items stored therein to be retrieved. As illustrated in FIG. 8C attachment component 820 has an attachment point, such as staple 826, associated therewith and configured such that a conventional keyed or combination lock may secure attachment portion 824 to staple 826, thereby securing storage system 100 to the structure from which it is suspended during use. It will be appreciated that so long as staple 826 is located in an area to which access is controlled, such as by panel 104, a simple bolt, clasp or other similar device may be used to securely join attachment portion 824 to attachment point 826. Alternately, attachment portion 824 may be locked to the shank portion 830 of attachment component 116, and need not pass through an opening in the body 102.

Figure 9:
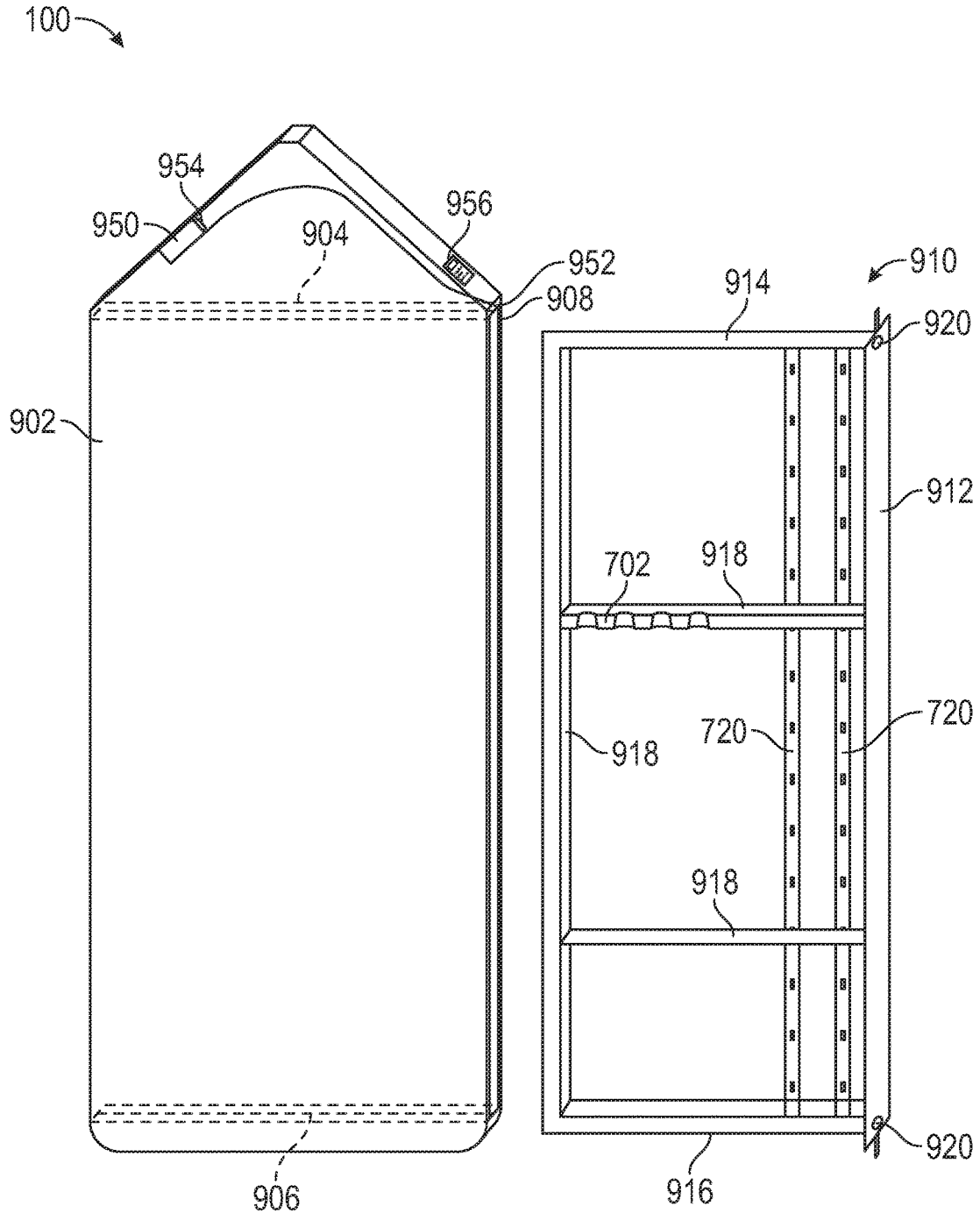
FIG. 9 illustrates yet another embodiment of a storage system.

FIG. 9 illustrates yet another embodiment of storage system 100 comprising a three-dimensional body 902 defining an interior volume. Disposed within the interior volume are track or guide systems 904 and 906. One transverse side of body 902 (i.e., the side defining the depth) has an opening 908 therein providing access to the interior volume. The embodiment of FIG. 9 further comprises a skeleton frame 910 having an end panel 912 that couples with the opening 908 to close off access to the interior volume. Skeleton frame 910 comprises rails 914 and 916, which operable engage with tracks 904 and 906, respectively, to receive and guide skeleton frame 910 into the interior volume. Skeleton frame 910 may comprise additional support elements 918 to provide necessary structural rigidity support for time that may be secured to the skeleton frame 910 for storage within the interior volume of body 902.

Skeleton frame 910 may be completely removable from body 902 or may be only partially removable from body 902. In a preferred form, skeleton 910 is completely removable for easy loading with items to be stored. Once the items to be stored are loaded on the skeleton 910, the skeleton may then be inserted along tracks 904 and 906 into the body 902. Panel 912 and adjacent portions of 902 may have one or more lock systems 920 for lockably securing skeleton 910 within the body 902. Alternately, the lock system 920 may be disposed on a distal end of skeleton 902 and a distal end or side of body 902 (i.e., opposite opening 908.

It will be appreciated that skeleton 910 may be configured with any of the foregoing systems for securing or holding items, such as but not limited to barrel stock 702, or rack systems 720, hook and loop systems.

Also shown in FIG. 9 is an alarm system 950, which may comprise magnetic contacts 952 between the body 902 and the skeleton 910 or panel 912. Such alarm system 950 may be configured to announce, such as by klaxon, unauthorized access to the interior volume of body 902, such as by unauthorized removable of skeleton 910. The alarm 950 may also be configured to announce unauthorized removal of storage system 100 from the device upon which it is hung, as illustrated a 954. The alarm system 950 may also comprise an arming/disarming panel 956 located on an exterior surface of body 902.

Figure 10:
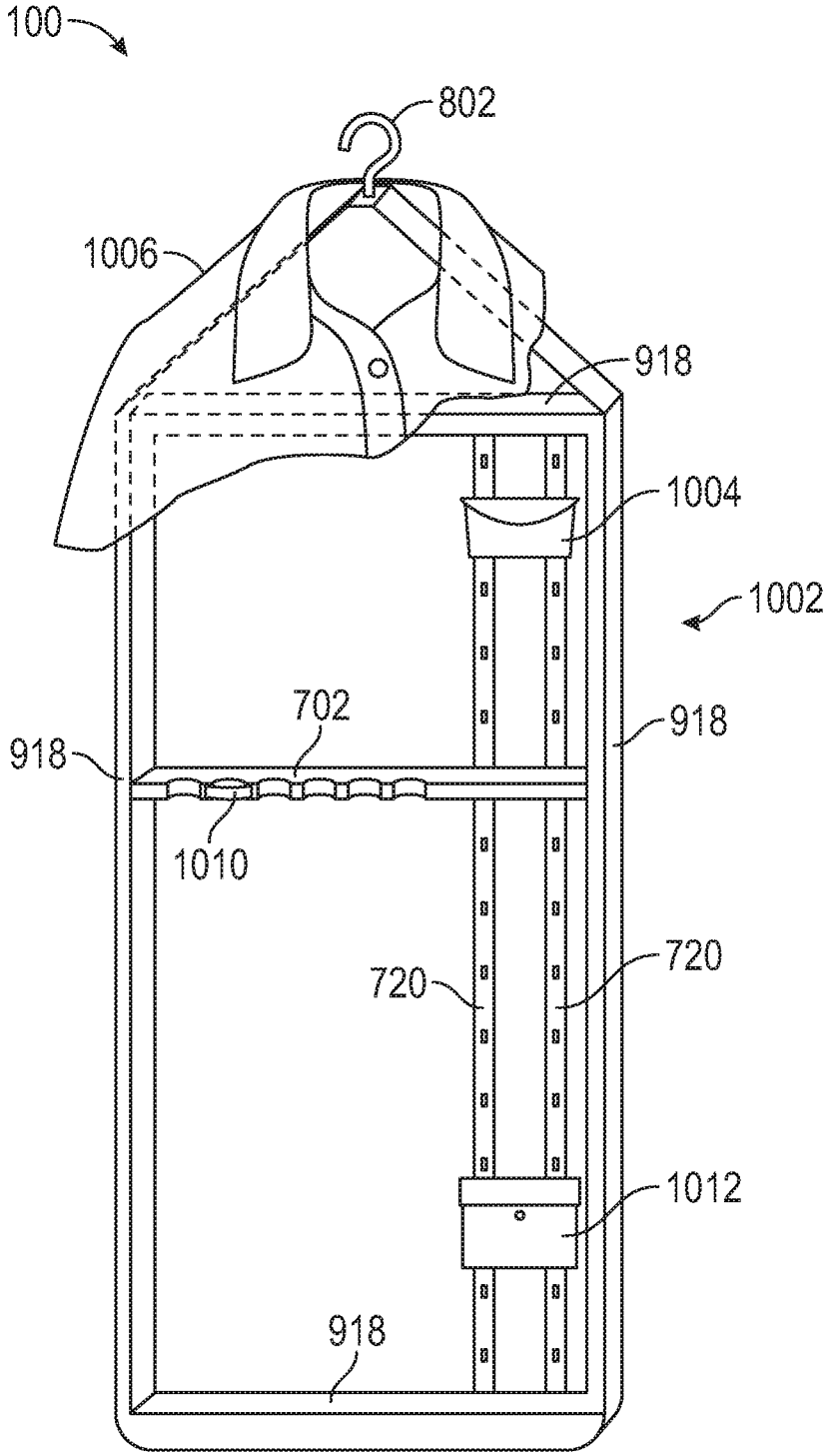
FIG. 10 illustrates a still further embodiment of a storage system.

FIG. 10 illustrates a still further embodiment of storage system 100. This embodiment is comprises a skeleton frame 1002 and no body. The skeleton 1002, similarly to skeleton 910 of FIG. 9, comprises structural elements 918 that cooperate to form the skeleton 1002 from which items may be secured or attached. For example, skeleton 1002 may further comprise a barrel stock 702, and/or rack systems 720, and/or other structural elements and surfaces to which items may be secured. As illustrated in FIG. 10 a pouch or container 1004 may be secured to the skeleton 1002 for storing items. The skeleton 1002 may be disguised by covering the skeleton 1002 with a clothing item 1006 and hanging the storage system 100 from a clothes rod with other clothing items adjacent, such as illustrated in FIG. 4. It will be appreciated that this embodiment provides security through disguise or camouflage, but not through physical security.

Alternately, a level of physical security can be provided by the embodiment illustrated in FIG. 10, such as by providing barrel stock 702 with a locking retention mechanism 1010. Also, a lockable box 1012 may be secured to rack system 720 with theft resistant screws or other secure attachments means.

Figure 11:
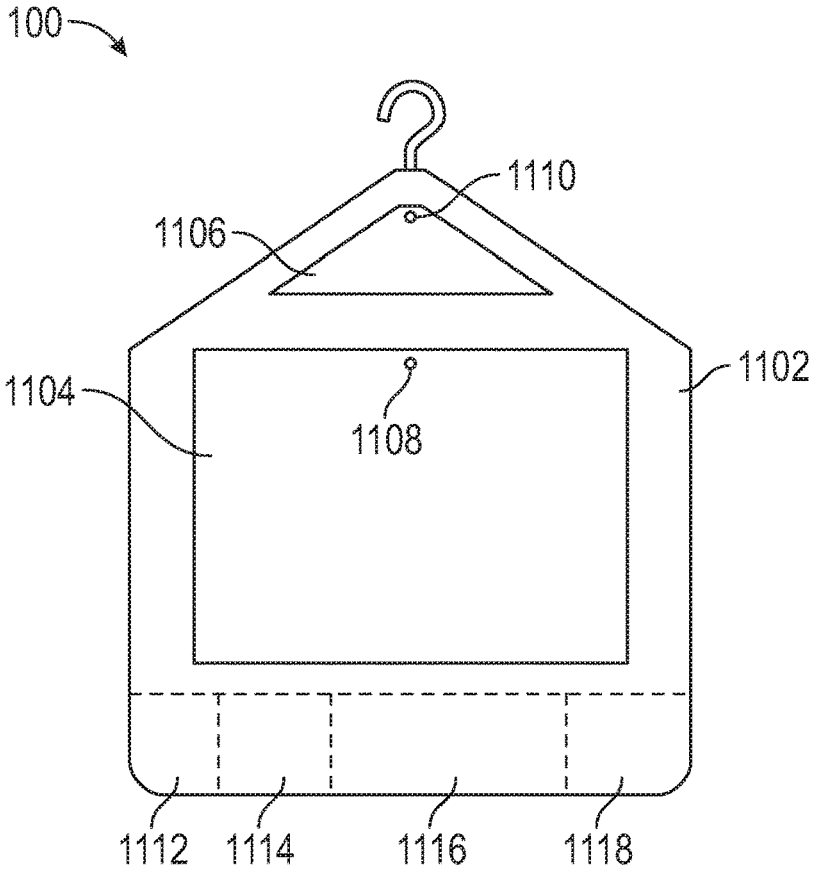
FIG. 11 illustrates another embodiment of a storage system.

FIG. 11 illustrates another embodiment of a storage system 100 comprising a body 1102 that is shorter than the embodiment 100 shown in FIG. 1. The embodiment 100 shown in FIG. 11 comprises a main panel 1104 providing and restricting access to a main interior storage volume and a secondary panel 1106 providing and restricting access to a secondary storage volume. The main panel 1104 and the secondary panel 1106 may comprise a lock system 1108 and 1110, such as those described for the embodiments above. FIG. 11 also illustrates internal compartments 1112 through 1118 constructed within the main interior volume. In other words, access to internal compartments 1112 through 1118 can be restricted by main panel 1104.

Figure 12:
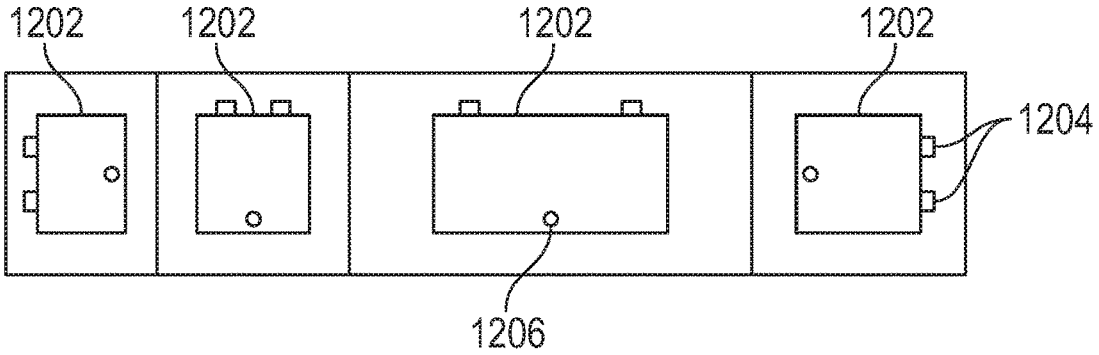
FIG. 12 illustrates internal compartments in a storage system.

FIG. 12 illustrates a plan view of internal compartments 1112 through 1118 and shows that one or more of the compartments may have additional security features such as a door or panel 1202 and/or hinges 1204 and/or lock system 1206.

It will be appreciated that the embodiment illustrated in FIG. 11 is suitable for secure storage of smaller items such as jewelry, papers, and other valuables and may be effectively disguised by covering with a shirt or other clothing item and hanging the storage system 100 in a closet.

Figure 13:
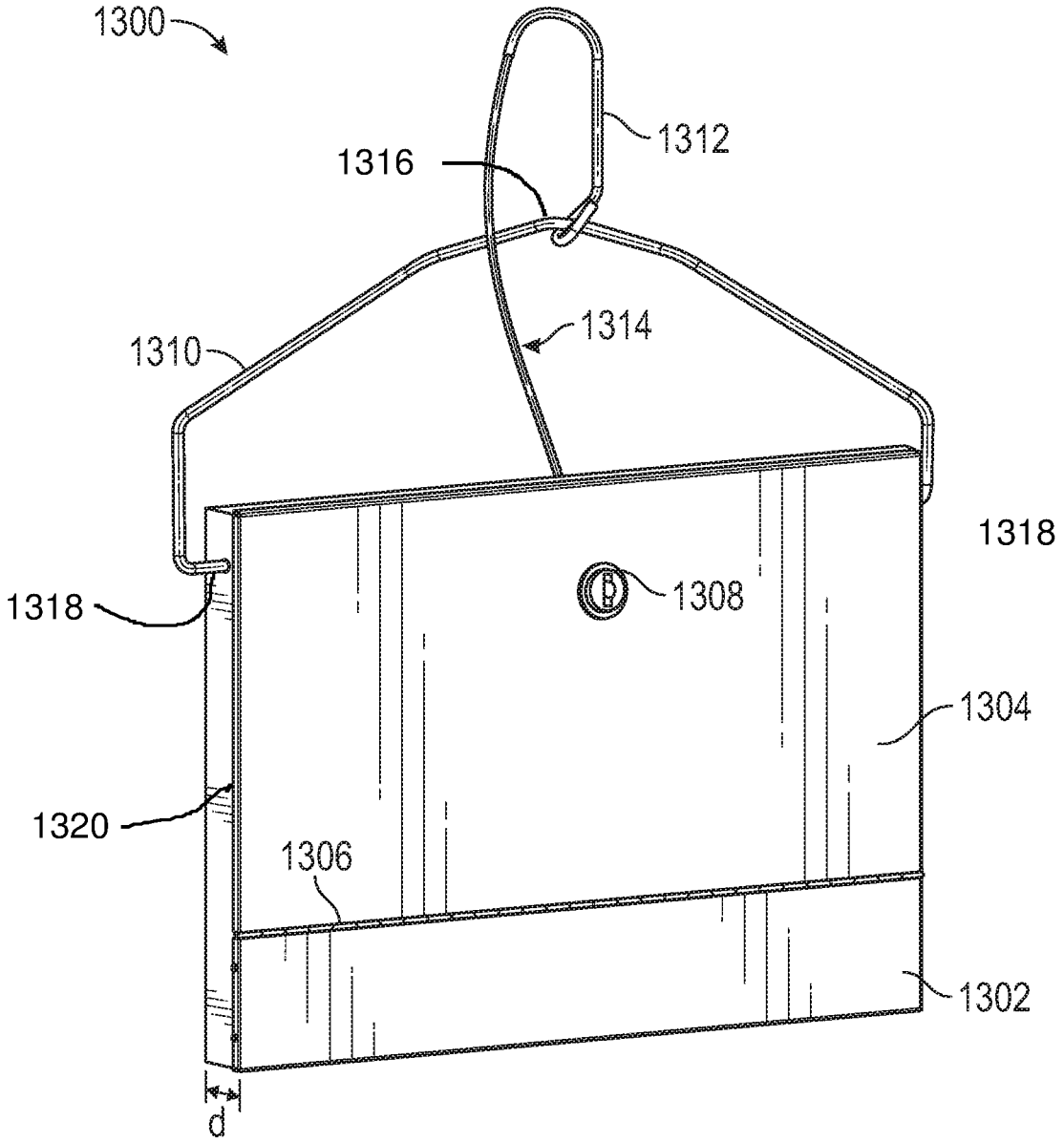
FIG. 13 illustrates one of many possible embodiments of a storage system incorporating aspects of the inventions taught herein.
Figure 14:
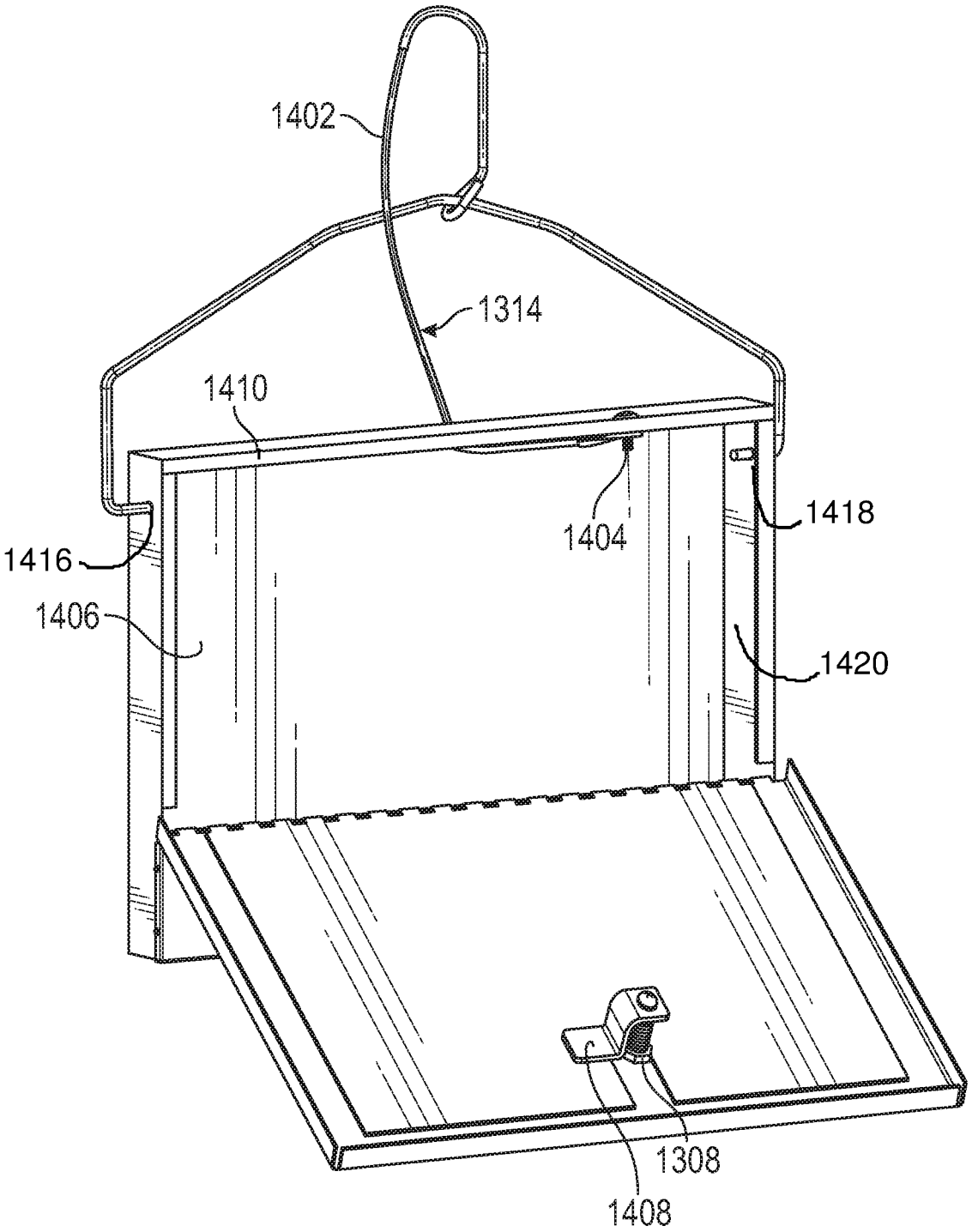
FIG. 14 illustrates the embodiment of FIG. 13 with the closure member in an opened condition.

Persons having skill in the art having benefit of this disclosure will now appreciate that there are many different possible embodiments of the disclosed safety storage systems described above that may be constructed consistent with this disclosure and the appended claims. FIGS. 13 and 14, for example, illustrate another possible embodiment comprising a body 1302 in the general shape of rectangle with a predetermined depth, "D", and panel, door or closure member 1304. Because one of the security aspects of the inventions disclosed herein comprises disguising the storage system 1300 as piece of hanging clothes, the predetermined depth, "d", may range between about 1 inch and about 4 inches, and most preferably between about 2 and about 3 inches. It has been found that the disguisability of such storage systems having a depth greater than about 3 inches decreases with increasing depth, although storage systems with depths greater than 4 inches are entirely possible and useful.

The body 1302 and closure member 1304 may be fabricated from any material or materials suitable for the purpose of the storage system 1300, but it is preferred that the material be aluminum or other lightweight, yet strong material. Steel is also a suitable material, but the density of steel may render a steel body 1302 and steel closure member 1304 too heavy for most applications. The closure member 1304 is shown coupled at one end to the body 1302 along a pivot. In FIG. 13, the pivot is shown to be a hinge assembly 1306, such as a piano hinge. The closure member 1304 is shown to comprise a lock 1308 configured to lockably secure the closure member 1304 to the body 1302, such that the cavity (shown in FIG. 14) is inaccessible for its intended storage purposes. Preferably, the lock 1308 may be located adjacent an end of the closure member 1304 substantially opposite the pivot 1306, and may comprise a quarter-turn keyed lock with cam 1408, or other lock system. In the locked condition, cam 1408 engages the body 1302, such as at lip 1410, to lock the closure member 1304 to the body 1302.

The particular embodiment illustrated in FIGS. 13 and 14 also comprises a hanger/hook assembly in the form of a hanger 1310 and a hook 1312. It is preferred, but not required that the hanger/hook assembly resemble a conventional clothes hanger to aid the disguisability of the storage system 1300. The hanger 1310 and the hook 1312 may be fabricated as a unitary piece, preferably from steel or aluminum. Alternately and preferably, the hanger 1310 and the hook 1312 may be fabricated as a separate pieces, again preferably from steel or aluminum, and configured such that the hanger 1310 (and therefore the body 1302) can rotate relative to the hook 1312 (and therefore the structure from which the hook 1312 is hung).

It is preferred, but not required that the hanger 1310 comprise an apex 1316 located substantially in line with the center of mass of the body (when empty), such that when the hanger 1310 and body 1302 combination is suspended at the apex, the body hangs substantially true. In the particular embodiment illustrated in FIGS. 13 and 14, the hanger 1310 has angled or curved ends 1318 that are configured to engage and extend through holes 1416 and 1418 formed in the sides 1320 and 1420 of the body 1302. As shown in FIGS. 13 and 14, the hanger ends 1318 may be oriented perpendicular to body sides 1320 and 1420. The structural relationship between the hanger ends 1318 and associated holes may allow the body 1302 to rotate or swing about to the hanger ends 1318. It will be appreciated that allowing relative movement or rotation between the hook 1312 and the hanger 1310, and relative movement or rotation between the hanger ends 1318 and the body 1302 is a desirable, but not required, feature when accessing the storage cavity while the storage system is hanging among clothes.

Another desirable feature of configuring the hook 1312 and hanger 1310 as separate pieces is the ability of the hook 1312 to slide down the hanger 1310 thereby allowing the apex portion 1316 of the hanger 1310 to be used as a handle for transporting the storage system 1300, such as from a car to a hotel room.

Figure 15:
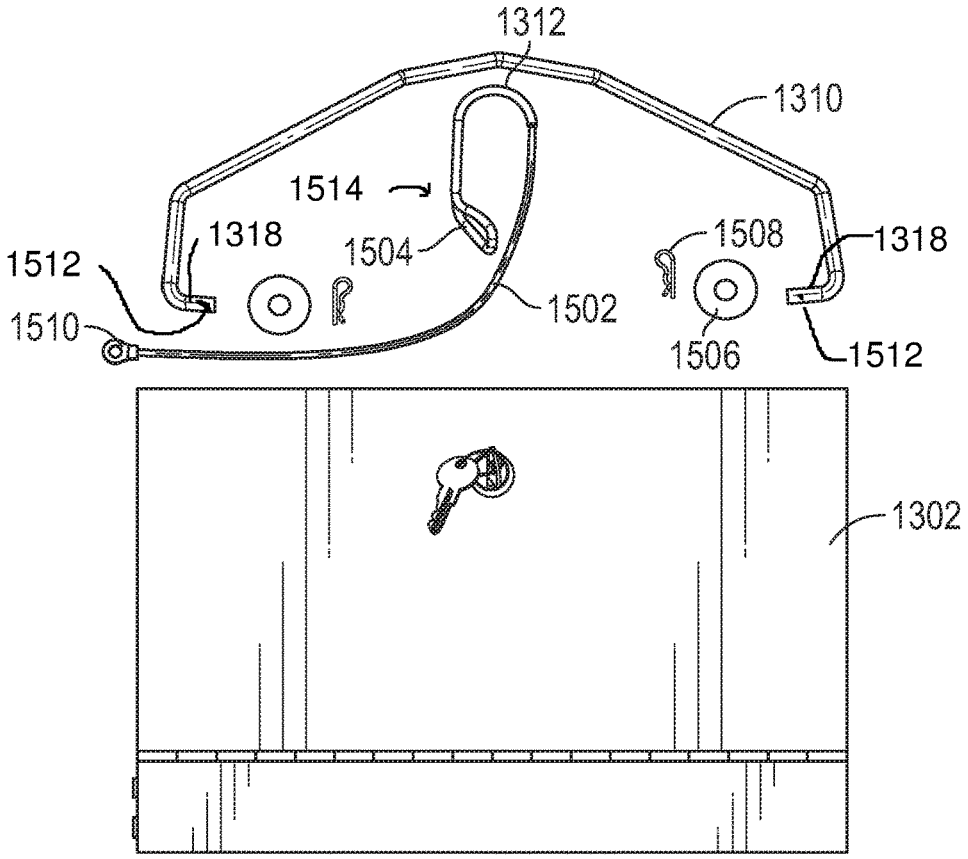
FIG. 15 illustrates an exploded view of a hanger and hook suitable for use with the embodiment of FIG. 13.

FIG. 15 is an exploded view of the hanger/hook assembly of the embodiment illustrated in FIGS. 13 and 14. The hanger 1310 is illustrated as a unitary structure with ends 1318. It is preferred, but not required, that the hanger 1310 be coupled to the body 1302 such that the hanger 1310 cannot be removed from the body 1302 when the closure member 1304 is locked to the body 1302. One of many possible embodiments comprises a hole 1512 passing transversely through each hanger end 1318 such that each hole 1512 is located within the cavity when the hanger 1301 is coupled to the body 1302. With the closure member 1304 is in the opened condition, a plate or washer 1506 can be inserted over the hanger end 1318 protruding into the cavity, and a pin 1508, preferably a removable cotter pin, may be inserted into the hole 1512. In this embodiment, the hanger 1310 is secured to the body 1302 when the closure member 1304 is locked to the body 1302, and the hanger 1310 is removable from the body 1302 when the closure member 1304 is in the opened condition. Also, the body 1302 is permitted to rotate or swing relative to hanger ends 1318. Also illustrated in FIG. 15 is hook assembly 1514 comprising a hook 1312, a locking cable 1502, an eye portion 1504, and a first engagement portion 1510, which preferably may comprise a ferrule.

Figure 16:
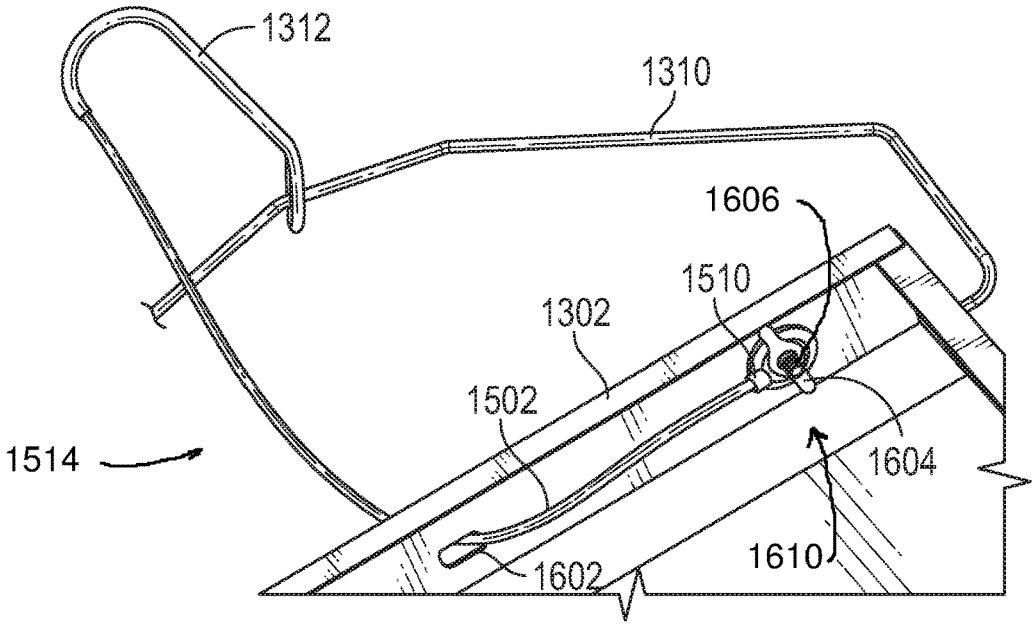
FIG. 16 illustrates a close up of a hook lock system suitable for use with the embodiment of FIG. 13.

FIG. 16 illustrates the hook assembly 1514 in the secured or locked condition. The hook cable 1502 is configured to pass through an aperture 1602 in the body 1302 that is preferably sized to pass the first engagement portion 1510 there through, but not allow meaningful access to the contents stored in the storage system. In other words, the aperture 1602 is preferably sized such that it does not function as a port to add storage items to the cavity or to remove stored items therefrom. After the first engagement portion 1510 is passed through the aperture 1602, the first engagement portion 1510 may be coupled or engaged to a corresponding second engagement portion 1608 to form a secure, but removable connection. It will be appreciated that when the first and second engagement portions 1510, 1610 are coupled, and when the closure member 1304 is secured to the body 1302, the storage system 1300 is secured or locked to the structure (not shown), such as a clothes rod, or a vehicle grab handle, from which it is suspended.

For example, when a person is travelling, the storage system 1300 can be loaded with valuable items and secured to the vehicle's grab handle or other substantial structure in the vehicle as described above. Upon arriving at a location, the closure member 1304 can be unlocked and opened and the first and second engagement portions uncoupled so that the storage system 1300 can be removed from the vehicle. The storage system 1300 can be carried, as described above, into for example, a hotel, and then re-secured to, for example, the clothes rod or clothes hanging system in the hotel room. So long as the closure member 1304 lock 1308 is activated, the contents of the storage system are secured against unauthorized access. So long as the hook lock is engaged and the closure member 1304 lock 1308 is activated, the storage system is secured against unauthorized removal from the structure from which it is suspended. Placing a clothing item, such as a shirt or a robe, over the storage system 1300 provides a third level of protection for the valuables stored in the storage system 1300.

Many forms of removable engagement portions 1510, 1610 are contemplated, including a swage lock system, and a keyed lock. Another embodiment is illustrated in FIG. 16 as comprising a threaded bolt, stud, or post 1606, a nut, such as wing nut 1604, and ferrule 1510. The ferrule can be placed over the threaded post 1606 and the wing nut 1604 can be used to removably secure the ferrule 1510 to the body 1302.

Figure 17:
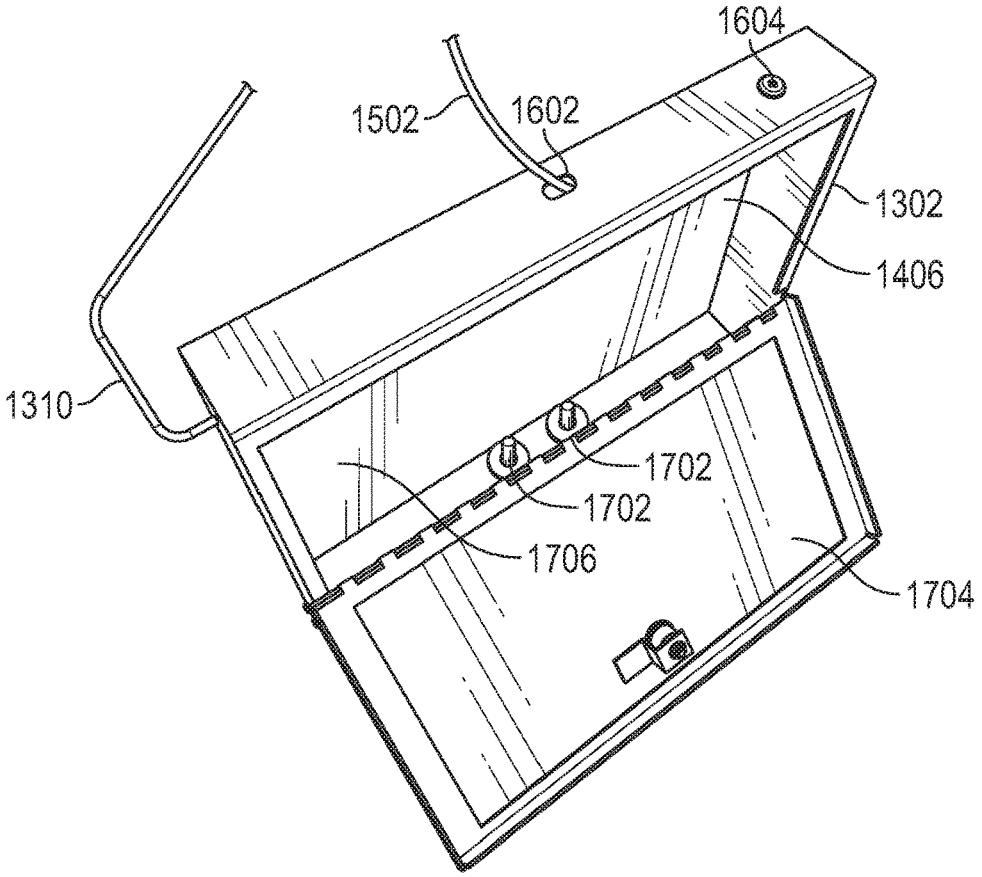
FIG. 17 illustrates a pistol storage system suitable for use with storage systems incorporating aspects of the inventions taught herein.

FIG. 17 illustrates one of many possible embodiments of the interior of body 1302 used to store valuables. For embodiments of storage systems 1300 configured to store one or more hand guns, one or more post assemblies 1702 may be provided over which a hand gun's barrel may be placed. The posts 1702 maintain the handgun in a substantially vertical orientation. Of course, handguns may be stored in a storage system without the use of posts 1702, but posts 1702 are a beneficial organizational component. A post assembly 1702 may comprise a threaded fastener, such a carriage bolt that passes through an opening in the bottom of the body 1302. A nut may be used to sandwich the body between the bolt head and the nut to secure the bolt to the body. A rubber, plastic or other "soft" sleeve may be placed over the exposed threads to protect the inside of the gun's barrel from the threads. A rubber, plastic or other "soft" spacer, or doughnut may be placed over the post to protect the end of the gun. Other handgun post assemblies are contemplated as well. To protect valuables generally, one or more of the interior surfaces of the body 1302 (i.e., the cavity) may be lined with soft, protective surfaces 1704, 1706, such as felt or spray coatings.

Figure 18:
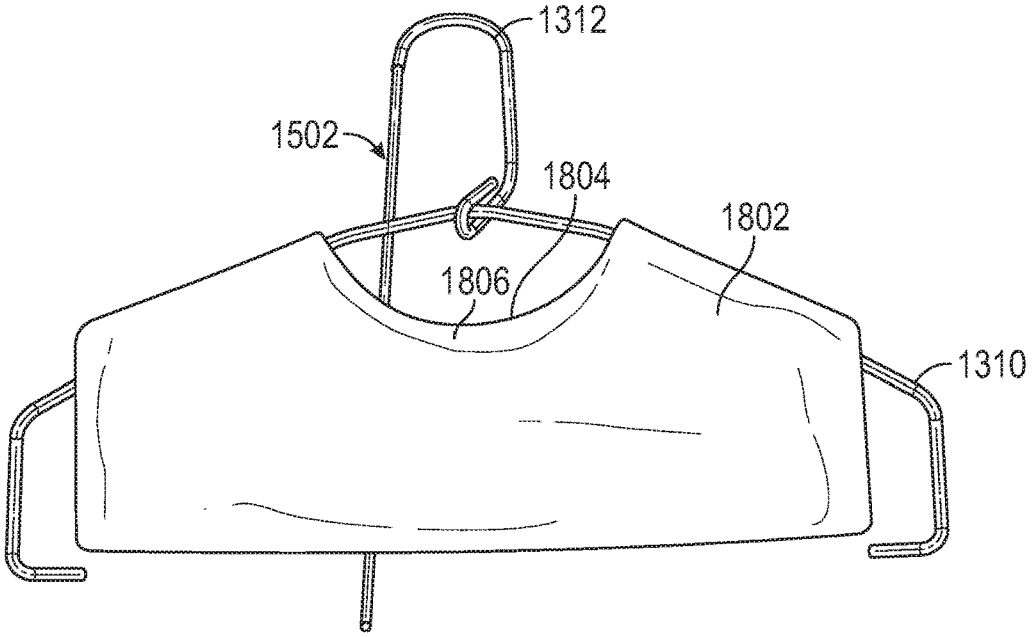
FIG. 18 illustrates a hanger storage system suitable for use with storage systems incorporating aspects of the inventions taught herein.

In addition to the securable interior cavity of the storage system 1300, it is also contemplated that a storage pouch may be located in the region between the hanger 1310 and the body 1302. In the particular embodiment illustrated in FIG. 17, a soft-sided pouch 1802, such as a fabric pouch, is configured such that it can be threaded onto hanger 1310, and supported by hanger 1301. The pouch 1802 may have a central opening 1804 through which provides access to the interior of the pouch. It is preferred, but not required, that the pouch 1802 be unsecured or unlocked so that rapid access to the contents placed therein is possible. However, to facilitate disguising the storage system 1300 as hanging clothes, the storage pouch may comprise a closure mechanism, such as a hook and loop fastener 1806, to bias the opening 1804 in a closed orientation. In the embodiment illustrated in FIG. 18, the hook cable 1502 does not pass through the pouch 1802, but rather passes on the outside of the pouch 1802. A storage pouch 1802 is useful for storing items such as key, smart phones and the like.

Figure 19:
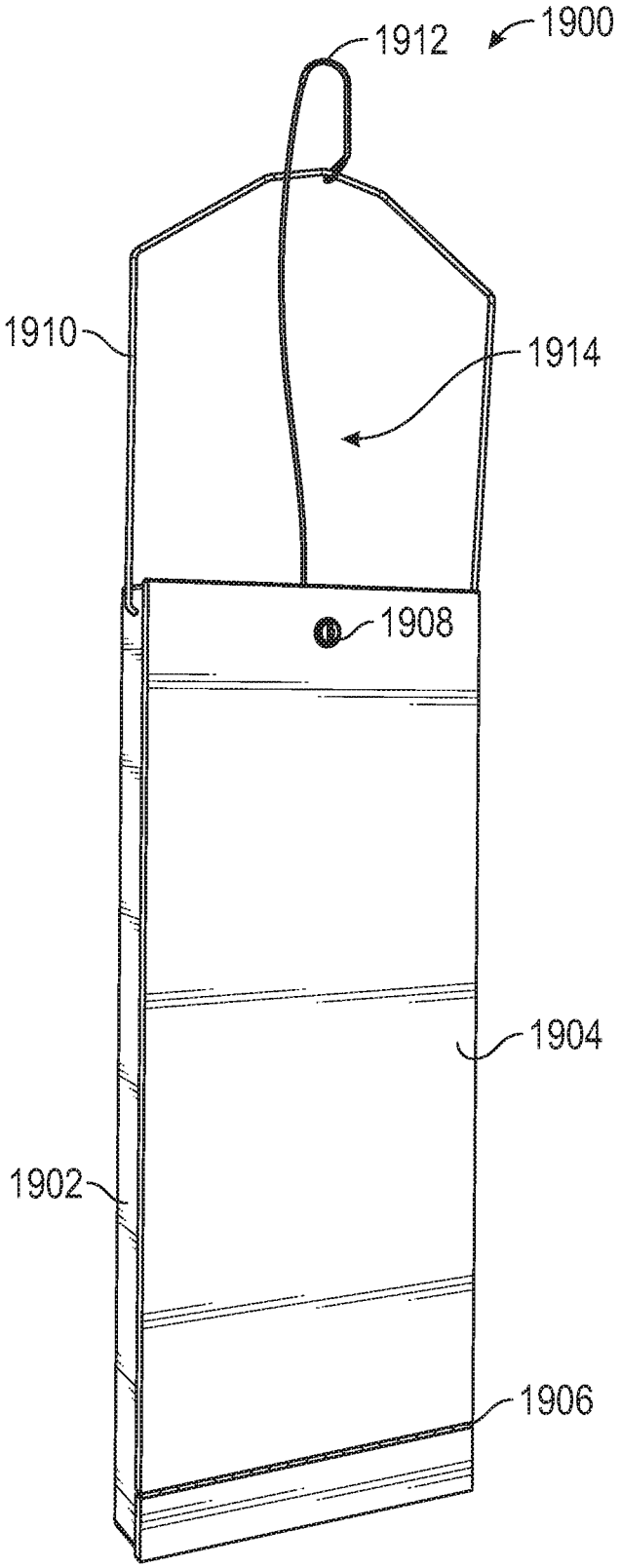
FIG. 19 illustrates another possible embodiment of a storage system incorporating aspects of the inventions taught herein suitable for storing long guns.
Figure 20:
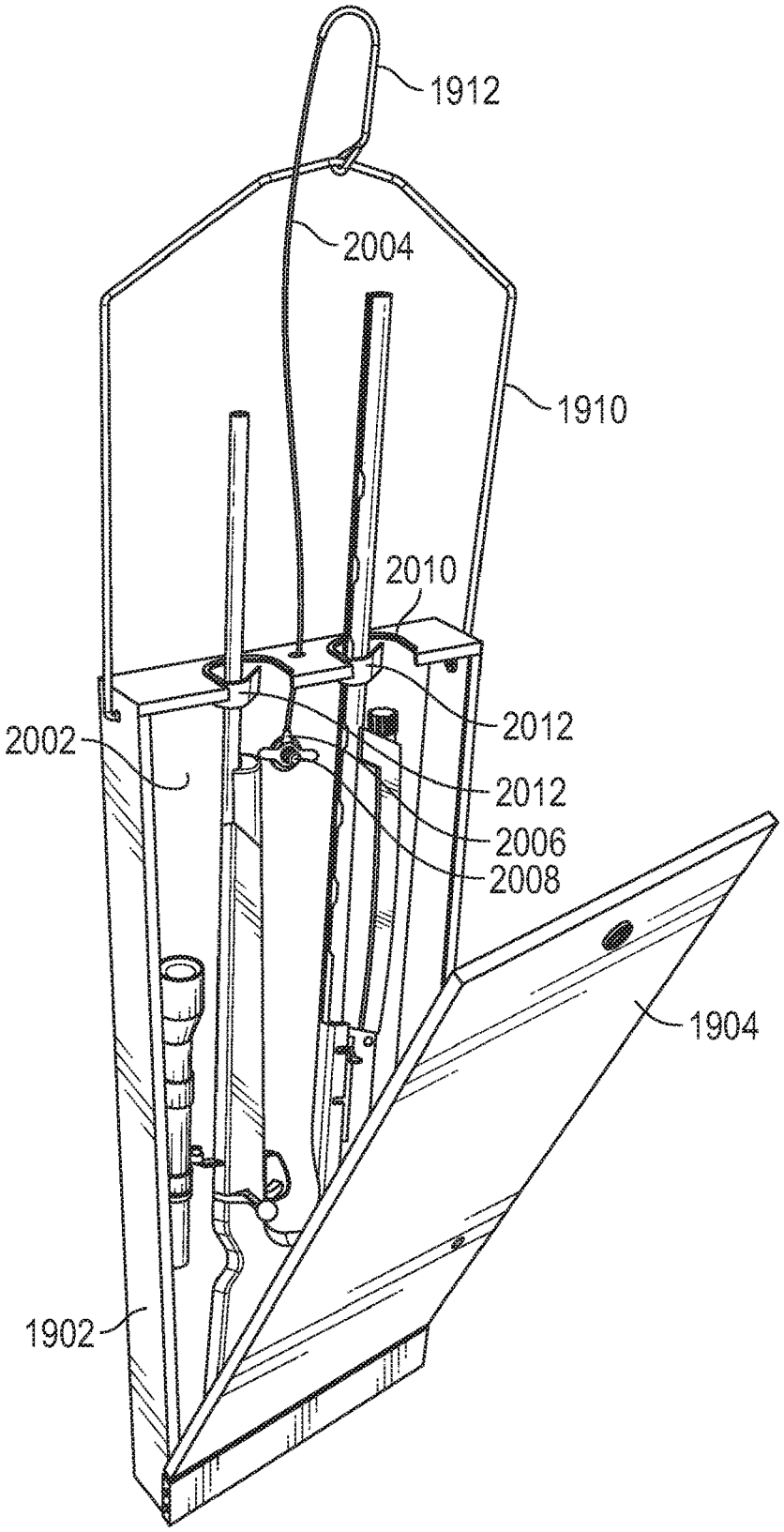
FIG. 20 illustrates the embodiment of FIG. 19 with the closure member in an opened condition.

FIGS. 19 and 20 illustrate another of many possible embodiments of the storage systems contemplated by this disclosure, and particularly suited for the secure storage of one or two long guns. Storage system 1900 is configured and functions substantially identically to the storage system 1300 illustrated in FIGS. 13-17. However, as illustrated, the body 1902 and hanger 1910 are modified, such as by lengthening, to accommodate the length of a long gun as shown in FIG. 20. As shown in FIG. 20, if the body 1902 is not as long as the long gun, barrel slots 2010 may be formed in the body 1902 so the gun barrel may extend beyond the body 1902. It is preferred that barrel slots 2010 be lined with a protective material to prevent scarring of gun barrels.

The hanger 1910 is sized such that the gun barrel resides in the space between the hanger 1910 and the body 1902. It is desirable, but not required that barrel retention devices 2012, such as hook and loop straps, be provided to prevent the long gun from falling from the body 1902 when the closure member 1904 is opened. Further, because the closure member 1904 typically will be much larger in a long gun storage system, the closure member 1904 may have its opening travel restricted so that it cannot open beyond about 45 degrees from vertical, and preferably open between about 25 and 35 degrees. A flexible cable or strap between the body 1902 and the closure member 1904 may be used to restrict the opening of the closure member 1904.

FIG. 20 also illustrates other components similar to those in FIGS. 13-17, including protective surface 2002, hook cable 2004, first engagement portion 2006, and second engagement portion 2008.

Figure 21:
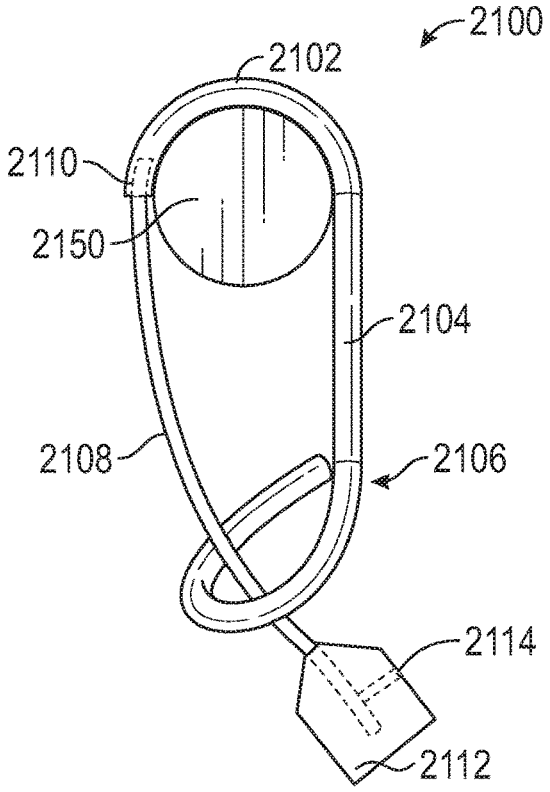
FIG. 21 illustrates another of the many possible embodiments of a hook lock system suitable for use with the inventions taught herein.

FIGS. 21-24 illustrate alternative hook locks suitable for use with all embodiments of storage systems disclosed herein. For embodiments that use a separate hook 2100 (i.e., separate from the hanger), FIG. 21 illustrates that a hook lock mechanism 2100 may comprise a cable 2108 configured to pass through an eye portion 2106 of the hook 2102. A lock, nut or obstruction 2112 sized to not pass through the eye portion 2106 and configured to be removably lockable to the cable 2108 may be provided. For example, obstruction 2112 may be a cylinder of metal having an aperture to receive at least a portion of the cable 2108 and a threaded aperture configured to receive a set screw to engage and secure the cable portion to the obstruction.

Figure 22:
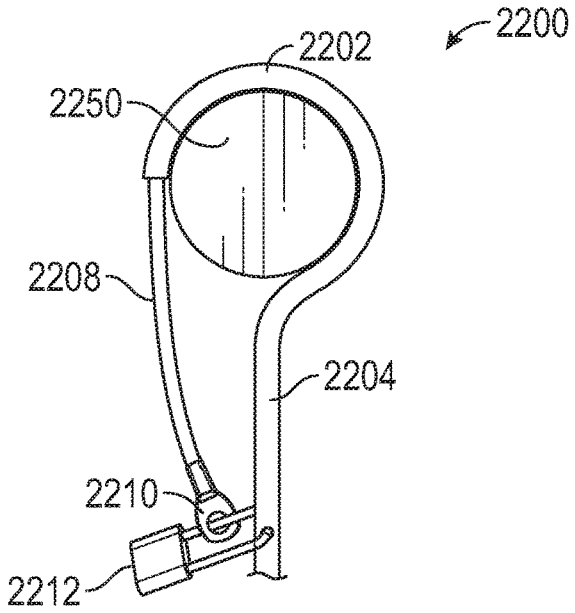
FIG. 22 illustrates yet another of the many possible embodiments of a hook lock system suitable for use with the inventions taught herein.

FIG. 22 illustrates that a hook lock mechanism may comprise a cable with one end secured to an end of the hook 2202 and the other end free. The free end of the cable may comprise a ferrule 2210 and configured to receive a lock 2212 shank there through. An aperture may be provided in the hook shank 2204 and configured to also receive a lock 2212 shank. In use, the lock 2212 shank may pass through the ferrule 2210 and the shank 2204 aperture to secure the cable to the shank.

Figure 23:
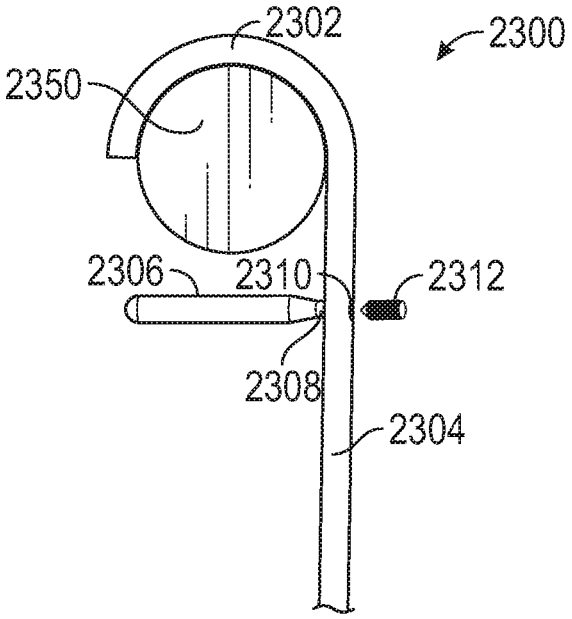
FIG. 23 illustrates yet another of the many possible embodiments of a hook lock system suitable for use with the inventions taught herein.
Figure 24:
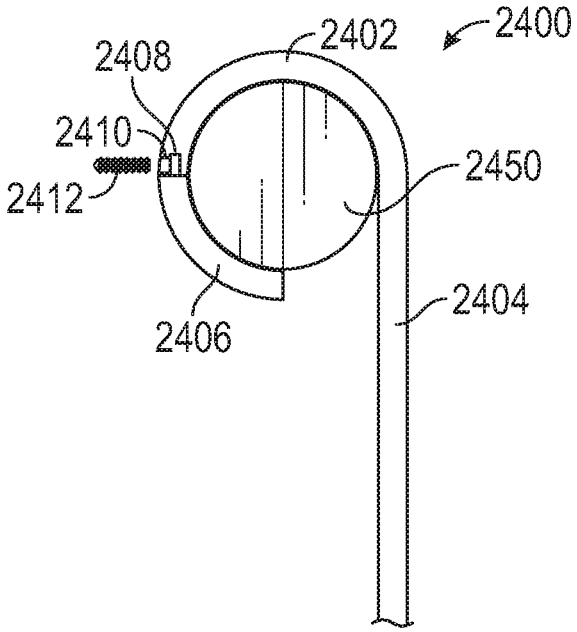
FIG. 24 illustrates yet another of the many possible embodiments of a hook lock system suitable for use with the inventions taught herein.

FIGS. 23 and 24 illustrate additional hook lock mechanism 2300 and 2400 suitable for use with all embodiments of the storage systems disclosed herein. In these embodiments, the hanger locking function is achieved through use of a removable hook component 2306, 2406. In FIG. 23, removable hook component 2306 is configured to mate with an aperture 2310 in the hook shank 2304 positioned adjacent the curved portion 2302, such that when the removable portion 2306 is in position, the hook 2302 cannot be removed the structure 2350 from which the storage system is suspended. Once the removable portion 2306 is positioned in the aperture 2310, a removable locking component 2312, such as set screw, may be used to removably secure the storage system to structure 2350.

FIG. 24 illustrates another embodiment in the removable component is configured to engage the end of the curved portion 2402 of the hook and extends the encirclement of the hook such that when the removable component in is position, the hook cannot be removed from structure 2450 from which it is suspended.

Thus, we have invented mobile, hanging, disguisable storage systems having up to three levels of security. First, the contents of the storage system may be locked against unauthorized access as described herein. Second, the storage system itself may be locked against unauthorized removal from where the storage system is hung. Third, the hanging storage system may be disguised a hanging piece of clothing rather than a storage system for valuables. In addition, or alternately, a storage system according to the disclosed inventions may also comprise hole place in the back of the body to permit the body to be mounted to a wall, such as closet wall behind hanging clothes, rather than being suspended among clothes.

Having the benefit of this disclosure, those persons having skill in the art will understand that each feature of the embodiments described with reference to a particular figure and can be used or combined with an embodiment of another feature to create still further embodiments that practice or encompass the inventions taught herein. Individual elements from each of the several embodiments described herein can be mixed and matched by a person of skill having benefit of this disclosure to create further and different embodiments within the scope of this disclosure and the appended claims.

Discussion of singular elements can include plural elements and vice-versa. The inventions have been described in the context of preferred and other embodiments and not every embodiment of the inventions has been described. Obvious modifications and alterations to the described embodiments are now readily apparent to those of skill in the art. The disclosed and undisclosed embodiments are not intended to limit or restrict the scope or applicability of the invention conceived of by the Applicants, but rather, in conformity with the patent laws, we intend to fully protect all such modifications and improvements that come within the scope or range of equivalent of the following claims.

What is claimed is:

1. A storage system, comprising:

a body having at least one cavity therein and configured to house one or more items;

an opening defined by the body and providing access to the cavity;

a member configured to prevent access to the cavity when the member covers the opening;

a first security mechanism operable between the body and the member to provide a secured condition in which the member is secured to the body preventing unauthorized access to the cavity, and an unsecured condition in which the member may be moved allowing access to the cavity;

a hanger having first and second ends each configured to mate with associated openings in the body such that the body can rotate relative to the ends, the hanger having an apex located substantially mid-way between the first and second ends, the first and second ends configured to be secured inside the body such that the ends cannot be removed from the body unless the member is unsecured;

a hook having an eye portion configured to engage the hanger apex and to permit the hanger and body to rotate relative to the hook, the hook having a second end comprising a curved portion and configured to suspend the storage system from a structure; and a second security mechanism configured to secure the storage system to the structure from which the system is suspended and having a first portion directly secured to an end of the curved portion of the hook and a second portion securable within the body, such that the second portion cannot be unsecured unless the member is in the unsecured condition.

2. The storage system of claim 1, further comprising a third security system mechanism comprising the body configured to be disguisable as hanging clothing when clothing is draped over the hanger and body.

3. The storage system of claim 1, wherein the hook is configured to allow easy removal of the storage system from the structure from which it is suspended when the second portion of the second security mechanism is not secured inside the body.

4. The storage system of claim 1, further comprising a post disposed with the cavity configured to be received by the barrel of the handgun.

5. The storage system of claim 1, wherein the first security mechanism comprises a keyed lock.

6. The storage system of claim 1, wherein the first security mechanism comprises a combination lock.

7. The storage system of claim 1, wherein the first security mechanism comprises a biometric lock.

8. The storage system of claim 1, wherein the first security mechanism comprises a finger print lock.

9. The storage system of claim 1, further comprising a second cavity within the body configured to house one or more items, a second opening defined by the body and providing access to the second cavity; a panel configured to mate with the second opening and prevent access to the second cavity; and a third security mechanism configured to secure the panel to the second opening.

10. The storage system of claim 1, further comprising an alarm system configured to warn of events selected from the group consisting of: unauthorized access to the cavity, unauthorized removal from the structure, and both.

11. The storage system of claim 1, wherein the second security mechanism comprises a threaded post, a ferrule, and a threaded nut.

12. The storage system of claim 1, wherein the body is configured to securely store at least one long gun.

13. The storage system of claim 12, wherein the body comprises a barrel slot for each long gun configured to allow the barrel to protrude from the body when the member is in the secured condition.

14. The storage system of claim 1, further comprising a pouch configured to be suspended by the hanger between the hanger and body and to provide unsecured storage of items.

15. A storage system, comprising:

a body having at least one cavity configured to house one or more items;

an opening in the body providing access to the at least one cavity;

a panel configured to prevent access to the at least one cavity through the opening;

a first lock system having a first key and operable between the body and the panel providing a locked condition in which the panel is locked to the body preventing access to the at least one cavity, and an unlocked condition allowing access to the at least one cavity;

a hanger and hook assembly, wherein the hanger is coupled to the body and configured to allow rotation between the hanger and the body, and wherein the hook is configured to couple to the hanger and to suspend the body from a structure;

a second lock system comprising a flexible member, a securing structure and an attachment portion, the flexible member having one end fixedly secured to an end portion of the hook and the attachment portion secured to another end, the securing structure positioned in an area the access to which is controlled by the first lock system;

an aperture in the body configured to pass the attachment portion there through without allowing removal of items stored in the cavity;

the second lock system configured to secure the storage system to the structure from which the storage system is suspended when the attachment portion is secured to the securing structure and the panel is locked to the body; and wherein the hook is configured to allow rotation between the hook and hanger when the attachment portion is secured to the securing structure.

16. The storage system of claim 15, wherein the hanger and body are configured to be covered by an article of clothing such that when suspended among hanging clothes, the storage system is substantially disguised as hanging clothing.

17. The storage system of claim 15, wherein the securing structure is a threaded post and nut.

18. The storage system of claim 15, where in at least some of cavity surfaces have a protective coating to prevent damage to stored items.

19. A storage system, comprising:

a body having at least one cavity configured to house one or more items;

an opening in the body providing access to the at least one cavity;

a panel configured to prevent access to the at least one cavity through the opening;

a first lock system having a first key and operable between the body and the panel providing a locked condition in which the panel is locked to the body preventing access to the at least one cavity, and an unlocked condition allowing access to the at least one cavity;

a hanger and hook assembly coupled to the body configured to suspend the body from a structure;

a second lock system comprising a flexible member, a threaded post and nut, and an attachment portion, the flexible member having one end fixedly secured to an end portion of the hook and the attachment portion secured to another end, the securing structure positioned in an area the access to which is controlled by the first lock system;

an aperture in the body configured to pass the attachment portion there through without allowing removal of items stored in the cavity; and the second lock system configured to secure the storage system to the structure from which the storage system is suspended when the attachment portion is secured to the threaded post with the nut and the panel is locked to the body.

20. The storage system of claim 19, wherein the hanger and body are configured to be covered by an article of clothing such that when suspended among hanging clothes, the storage system is substantially disguised as hanging clothing.

* * * * *